US009211011B2

(12) United States Patent
Hashida et al.

(10) Patent No.: US 9,211,011 B2
(45) Date of Patent: Dec. 15, 2015

(54) ANGLE ADJUSTER

(71) Applicant: HIKARI Co., Ltd., Kashiwara-shi, Osaka (JP)

(72) Inventors: Shigetaka Hashida, Kashiwara (JP); Takeshi Yamawaki, Kashiwara (JP); Yoshi Sakurai, Kashiwara (JP); Masao Honda, Kashiwara (JP)

(73) Assignee: Hikari Co., Ltd, Osaka (JP)

( * ) Notice: Subject to any disclaimer, the term of this patent is extended or adjusted under 35 U.S.C. 154(b) by 0 days.

(21) Appl. No.: 14/398,153

(22) PCT Filed: Feb. 22, 2013

(86) PCT No.: PCT/JP2013/054472
§ 371 (c)(1),
(2) Date: Oct. 31, 2014

(87) PCT Pub. No.: WO2013/164921
PCT Pub. Date: Nov. 7, 2013

(65) Prior Publication Data

US 2015/0130246 A1 May 14, 2015

(30) Foreign Application Priority Data

May 1, 2012 (JP) ..... 2012-104700

(51) Int. Cl.
*A47C 1/027* (2006.01)
*A47C 1/026* (2006.01)

(52) U.S. Cl.
CPC ..... *A47C 1/027* (2013.01); *A47C 1/026* (2013.01)

(58) Field of Classification Search
CPC ..... A47C 1/026; A47C 1/027; B60N 2/22
See application file for complete search history.

(56) References Cited

U.S. PATENT DOCUMENTS 3,216,766 A * 11/1965 Tabor ..... 297/374
3,515,433 A * 6/1970 Tabor ..... 297/374

(Continued)

FOREIGN PATENT DOCUMENTS

CN 1590788 A 3/2005
CN 101992710 A 3/2011

(Continued)

OTHER PUBLICATIONS

Official Communication issued in International Patent Application No. PCT/JP2013/054472, mailed on Mar. 19, 2013.

*Primary Examiner* — Philip Gabler
(74) *Attorney, Agent, or Firm* — Keating and Bennett, LLP

(57) ABSTRACT

An angle adjuster (71) is equipped with a first arm (1) provided with a winding-and-tightening member (5) and a second arm (10) provided with a rotation shaft portion (13). As seen in the axial direction of the rotation shaft portion (13), one end portion (5*a*) and the other end portion (5*b*) of the winding-and-tightening member (5) are provided at the first arm (1) in a manner in which they are separated from each other. The first arm (1) and the second arm (10) are connected so that the second arm (10) is rotatable centering the rotation shaft portion (13) in a state in which the winding-and-tightening portion (6) of the winding-and-tightening member (5) is wound on the outer peripheral surface (13*a*) of the rotation shaft portion (13). It is configured so that a rotation of the second arm (10) by a frictional force (SM) and (GM) generated by a rotational movement of the second arm (10) in a forward rotation direction (S) or a reverse rotation direction (G) is allowed or prevented.

23 Claims, 25 Drawing Sheets

(56) References Cited

U.S. PATENT DOCUMENTS

| | | | | | |
|---|---|---|---|---|---|
| 3,779,655 | A | * | 12/1973 | Toyota | 403/93 |
| 3,918,822 | A | * | 11/1975 | Rauschenberger | 403/62 |
| 4,354,710 | A | * | 10/1982 | Rauschenberger | 297/356 |
| 6,789,848 | B2 | * | 9/2004 | Rauschenberger et al. | 297/369 |
| 7,632,035 | B2 | * | 12/2009 | Cheng | 403/98 |
| 2005/0046260 | A1 | | 3/2005 | Yamashita | |
| 2011/0042994 | A1 | | 2/2011 | Saito et al. | |

FOREIGN PATENT DOCUMENTS

| | | | |
|---|---|---|---|
| CN | 102448347 | A | 5/2012 |
| JP | 58-101316 | A | 6/1983 |
| JP | 2002-177082 | A | 6/2002 |
| JP | 2006-207756 | A | 8/2006 |
| JP | 2006-230720 | A | 9/2006 |
| JP | 2006-340798 | A | 12/2006 |
| JP | 2009-045395 | A | 3/2009 |
| JP | 2011-167354 | A | 9/2011 |

* cited by examiner

ANGLE ADJUSTER

TECHNICAL FIELD

The present invention relates to an angle adjuster for use in furniture and a reclining chair equipped with the angle adjuster.

In this specification, unless otherwise clearly specified, the wording of "positionally fixed" is used to include the meaning of "pivotally fixed," and "fixed position" is used to include the meaning of "pivotally fixed position."

BACKGROUND TECHNIQUE

As an angle adjuster for adjusting the inclination angle of a back frame of a reclining chair as one example of furniture, various structures are known, as disclosed in, e.g., Japanese Unexamined Patent Application Publication No. 2002-177082 (Patent Document 1), Japanese Unexamined Patent Application Publication No. 2006-230720 (Patent Document 2) and Japanese Unexamined Patent Application Publication No. 2006-340798 (Patent Document 3).

Such an angle adjuster is equipped with a first arm and a second arm. The first arm and the second arm are connected so that the second arm is rotatable relative to the first arm. Also, a seat frame is attached to the first arm and the back frame is attached to the second arm. Such an angle adjuster is structured so as to be able to adjust a development angle of the second arm to the first arm in a stepwise manner using engagement of gear teeth and a ratchet claw. Therefore, the development angle of the second arm cannot be adjusted steplessly, so fine angle adjustments corresponding to a user's liking and degree of fatigue could not be performed. Also, when rotating the second arm in a forward rotation direction to adjust the development angle of the second arm (e.g., a direction to reduce the development angle of the second arm), there is a drawback that a "click" sound is produced to bother people around the user.

The angle adjuster disclosed in Japanese Unexamined Patent Application Publication No. 2009-45395 (Patent Document 4) is capable of adjusting the development angle of the second arm to the first arm in a non-stepwise manner.

In this angle adjuster, a cylindrical fixed boss portion is provided at the first arm (immovable metal fitting) in a fixed and protruded manner, and a rotation boss portion is integrally provided at a second arm (movable metal fitting) so as to rotate together with the second arm. The base portion of the rotation boss portion is inserted into the fixed boss portion from the tip end side of the fixed boss portion in a rotatable manner, and the tip portion of the rotation boss portion is arranged so as to protrude from the tip end of the fixed boss portion. A twist coil spring is outwardly fitted on the fixed boss portion. One end portion of the twist coil spring is fixed to the tip end of the rotation boss portion and the other end portion of the twist coil spring is fixed to the first arm. When the rotation boss portion of the second arm rotates in a reverse rotation direction, the one end portion of the twist coil spring rotates integrally with the rotation boss portion, reducing the diameter of the twist coil spring to thereby wind and tighten the outer peripheral surface of the fixed boss portion, which in turn prevents the rotation of the second arm in the reverse rotation direction.

PRIOR ART DOCUMENT

Patent Document

Patent Document 1: Japanese Unexamined Patent Application Publication No. 2002-177082

Patent Document 2: Japanese Unexamined Patent Application Publication No. 2006-230720

Patent Document 3: Japanese Unexamined Patent Application Publication No. 2006-340798

Patent Document 4: Japanese Unexamined Patent Application Publication No. 2009-45395

SUMMARY OF THE INVENTION

Problems to be Solved by the Invention

In this angle adjuster, however, the thickness dimension of the angle adjuster is determined by the total length of the protruded length of the fixed boss portion and the protruded length of the tip portion of the rotation boss portion, and therefore it was difficult to reduce the size (thinning) of the angle adjuster.

Furthermore, when assembling the angle adjuster, it was required to fix the one end portion of the twist coil spring to the tip end of the rotation boss portion so that the winding-and-tightening force of the twist coil spring acts on the outer peripheral surface of the fixed boss portion along the whole range of the adjustable range of the development angle of the second arm. Therefore, the assembling operation was difficult.

The present invention was made in view of the aforementioned technical background, and aims to provide an angle adjuster capable of being reduced in size and easily assembled.

Other objects of the present invention will become apparent from the following preferred embodiments.

Means to Solve the Problems

The present invention provides the following means.

(1) An angle adjuster comprising:

a first arm equipped with a winding-and-tightening member; and a second arm equipped with a rotation shaft portion, wherein, the rotation shaft portion is provided at the second arm so as to rotate together with the second arm, as seen in an axial direction of the rotation shaft portion, one end portion of the winding-and-tightening member and the other end portion of the winding-and-tightening member are arranged apart from each other and provided at the first arm, the first arm and the second arm are connected so that the second arm is rotatable relative to the first arm about the rotation shaft portion in a state in which a winding-and-tightening portion of the winding-and-tightening member is wound around an outer peripheral surface of the rotation shaft portion, a frictional force in a forward rotation direction of the second arm generated at a contact portion between the outer peripheral surface of the rotation shaft portion and an inner peripheral surface of the winding-and-tightening portion of the winding-and-tightening member by a rotational movement of the second arm in the forward rotation direction acts on the winding-and-tightening member in a loosening direction that loosens tightening of the outer peripheral surface of the rotation shaft portion to decrease a winding-and-tightening force of the winding-and-tightening member against the outer peripheral surface of the rotation shaft portion to thereby allow a rotation of the second arm in the forward rotation direction, and a frictional force in a reverse rotation direction of the second arm generated at the contact portion by a rotational movement of the second arm in the reverse rotation direction acts on the winding-and-tightening member in a winding-and-tightening direction that tightens the outer peripheral surface of the rotation shaft portion to increase the winding-and-tightening force of the winding-and-tightening member against the outer peripheral surface of the rotation shaft portion to thereby prevent a rotation of the second arm in the reverse rotation direction.

(2) The angle adjuster as recited in item 1, wherein the winding-and-tightening member has spring elasticity in the winding-and-tightening direction and the loosening direction, and in a state in which the winding-and-tightening portion of the winding-and-tightening member is wound around the outer peripheral surface of the rotation shaft portion, the outer peripheral surface of the rotation shaft portion is wound and tightened by spring elasticity of the winding-and-tightening member.

(3) The angle adjuster as recited in the aforementioned item 1 or 2, wherein the one end portion and the other end portion of the winding-and-tightening member are positionally fixed to the first arm, and as seen in the axial direction of the rotation shaft portion, when a fixed position of the one end portion of the winding-and-tightening member to the first arm is denoted by a first fixed portion;

a fixed position of the other end portion of the winding-and-tightening member to the first arm is denoted by a second fixed position;

a linear distance between the first fixed position and a central position of the winding-and-tightening portion of the winding-and-tightening member is denoted by a first distance; and a linear distance between the second fixed position and the central position of the winding-and-tightening portion of the winding-and-tightening member is denoted by a second distance, the second distance is set to be shorter than the first distance, the forward rotation direction of the second arm is set in a rotation direction of unwinding a section of the winding-and-tightening portion of the winding-and-tightening member on a side of the first fixed position from the outer peripheral surface of the rotation shaft portion, and the reverse rotation direction of the second arm is set in a rotation direction of winding a section of the winding-and-tightening portion of the winding-and-tightening member on the side of the first fixed position on the outer peripheral surface of the rotation shaft portion.

(4) The angle adjuster as recited in the aforementioned item 3, wherein, as seen in the axial direction of the rotation shaft portion, when a line connecting the first fixed position and the central position of the winding-and-tightening portion of the winding-and tightening member is denoted by a reference line, the second fixed position is arranged within a range of ±45° with respect to the reference line centering the central position of the winding-and-tightening portion.

(5) The angle adjuster as recited in the aforementioned tem 3, wherein, as seen in the axial direction of the rotation shaft portion, when a line connecting the first fixed position and the central position of the winding-and-tightening portion of the winding-and tightening member is denoted by a reference line, the second fixed position is arranged within a range of 0° to 45° to a downstream side in the reverse rotation direction of the rotation shaft portion of the second arm with respect to the reference line centering the central position of the winding-and-tightening portion.

(6) The angle adjuster as recited in any one of the aforementioned items 1 to 5, wherein the winding-and-tightening member is formed separately from the first arm.

(7) The angle adjuster as recited in item 6, wherein the one end portion and the other end portion of the winding-and-tightening member are pivotally fixed to the first arm.

(8) The angle adjuster as recited in any one of the aforementioned items 1 to 7, wherein the winding-and-tightening member is formed by punching out a blank metal plate along an outer shape of the winding-and-tightening member in a thickness direction of the blank metal plate and has spring elasticity in the winding-and-tightening direction and the loosening direction.

(9) The angle adjuster as recited in any one of the aforementioned items 1 to 8, wherein the inner peripheral surface of the winding-and-tightening portion of the winding-and-tightening member is in contact with the outer peripheral surface of the rotation shaft portion in a region of 180° (degrees) or more centering an axial center position of the rotation shaft portion.

(10) The angle adjuster as recited in any one of the aforementioned items 1 to 9, wherein the inner peripheral surface of the winding-and-tightening portion of the winding-and-tightening member is formed into a shape corresponding to a shape of the outer peripheral surface of the rotation shaft portion.

(11) The angle adjuster as recited in any one of the aforementioned items 1 to 10, further comprising a control means of controlling an amount of deformation in the winding-and-tightening direction of the winding-and-tightening member caused by an action of a friction force in the reverse rotation direction applied to the winding-and-tightening member in the winding-and-tightening direction.

(12) The angle adjuster as recited in the aforementioned item 11, wherein the control means includes a control member and a control hole formed in the rotation shaft portion so as to extend in the axial direction of the rotation shaft portion, a diameter of the control hole is set to be larger than a diameter of the control member, the control member is arranged inside the control hole, and the control means is configured such that, when the amount of deformation in the winding-and-tightening direction of the winding-and-tightening member reaches a predetermined amount, an inner peripheral surface of the control hole comes into contact with the control member to thereby control the amount of deformation of the winding-and-tightening member in the winding-and-tightening direction.

(13) The angle adjuster as recited in the aforementioned item 12, wherein a pair of outer plate portions arranged apart from each other in an opposed manner are provided at the first arm, and the winding-and-tightening member and the rotation shaft portion are arranged between both the outer plate portions, wherein the control hole is formed in the rotation shaft portion in a penetrated manner in the axial direction of the rotation shaft portion, the control member is constituted by a rivet, an insertion hole for the control member is formed in each of the outer plate portions, and both the outer plate portions are connected to each other via the control member inserted through both the insertion holes and the control hole.

(14) The angle adjuster as recited in the aforementioned items 12 or 13, wherein the control means is configured such that, when an amount of deformation in the loosening direction of the winding-and-tightening member generated by an action of a frictional force in the forward rotation direction applied to the winding-and-tightening member in the loosening direction reaches a predetermined amount, the inner peripheral surface of the control hole comes into contact with the control member to thereby control the amount of deformation of the winding-and-tightening member in the loosening direction.

(15) The angle adjuster as recited in any one of the aforementioned items 1 to 14, wherein the first arm is provided with a stopper portion for stopping a rotation of the second arm in the forward rotation direction by being brought into contact with the second arm maximally rotated in the forward rotation direction.

(16) The angle adjuster as recited in any one of the aforementioned items 1 to 15, further comprising a release means configured to release prevention of the rotation of the second arm in the reverse rotation direction.

(17) The angle adjuster as recited in the aforementioned item 16, wherein the release means includes a pressing member which presses and deforms the winding-and-tightening member in the loosening direction to reduce the winding-and-tightening force of the winding-and-tightening member to thereby release the prevention of the rotation of the second arm in the reverse rotation direction, and a rotation plate portion integrally formed on the second arm in a rotatable manner, the pressing member is arranged movably between a pressing position where the winding-and-tightening member is pressed and deformed in the loosening direction and a non-pressing position where the winding-and-tightening member is not pressed and deformed, and the rotation plate portion is provided with a first pushing portion for pushing the pressing member arranged at the non-pressing position to the pressing position when the second arm maximally rotates to the forward rotation direction.

(18) The angle adjuster as recited in the aforementioned item 17, wherein the rotation plate portion is further provided with a second pushing portion for pushing the pressing member arranged at the pressing position to the non-pressing position when the second arm maximally rotates in the reverse rotation direction.

(19) The angle adjuster as recited in the aforementioned items 17 and 18, wherein the pressing member is arranged on an outside of the outer peripheral surface of a section of the other end portion side of the winding-and-tightening portion of the winding-and-tightening member, the first am is provided with a pressing portion for pressing the pressing member arranged at the pressing position against the outer peripheral surface of the section of the other end portion side, the pressing portion is arranged so that a space between the pressing portion and the outer peripheral surface of the section of the other end portion side is smaller than a thickness dimension of the pressing member, and the pressing member is forcefully pressed in between the pressing portion and the outer peripheral surface of the section of the other end portion side so as to be arranged at the pressing position from the non-pressing position, so that the pressing member is pressed against the outer peripheral surface of the section of the other end portion side by the pressing portion to thereby press and deform the winding-and-tightening member in the loosening direction.

(20) The angle adjuster as recited in the aforementioned items 17 or 18, wherein the first arm is equipped with a pair of the winding-and-tightening members, both the winding-and-tightening members are arranged in an opposed manner sandwiching a spacer member for forming a gap between both the winding-and-tightening members, the spacer member is attached to the first arm in a fixed state, the rotation shaft portion is integrally formed at an approximately central portion of the rotation plate portion so as to rotate together with the rotation plate and protrude to both sides in a thickness direction of the rotation plate portion, the rotation plate portion is arranged at the gap between both the winding-and-tightening members, and each of the rotation shaft portions is arranged inside both the winding-and-tightening portions of both the winding-and-tightening members in a rotatable manner, the pressing member is arranged on outside of both the outer peripheral surfaces of sections of both the other end portion sides of both the winding-and-tightening portions of both the winding-and-tightening members so as to bridge both the outer peripheral surfaces of sections of both the other end portion sides, the spacer member is provided with a pressing portion for pressing the pressing member arranged at the pressing position against both the outer peripheral surfaces of the sections of both the other end portion sides, the pressing portion is arranged so that a space between the pressing portion and both the outer peripheral surfaces of sections of both the other end portion sides is smaller than a thickness dimension of the pressing member, and the pressing member is forcefully pressed in between the pressing portion and both the outer peripheral surfaces of sections of both the other end portion sides so as to be arranged at the pressing position from the non-pressing position, so that the pressing member is pressed against both the outer peripheral surfaces of the sections of both the other end portion sides by the pressing portion to thereby press and deform both the winding-and-tightening members in the loosening direction.

(21) The angle adjuster as recited in any of one of the aforementioned items 1 to 20, wherein a cover member for covering the winding-and-tightening member from at least one of a top side or a bottom side is provided in a detachable manner.

(22) The angle adjuster as recited in any one of the aforementioned items 1 to 21, wherein the rotation shaft portion is formed separately from the second arm, the rotation shaft portion is provided with an engaging hole of a non-circular cross-sectional shape, the second arm is integrally provided with a fitting shaft portion of a non-circular cross-sectional shape corresponding to the engaging hole in a rotatable manner, and the fitting shaft portion is fitted in the engaging hole in a detachable manner to thereby integrally connect the rotation shaft portion to the second arm.

(23) A reclining chair in which a seat frame is attached to the first arm of the angle adjuster as recited in any one of the aforementioned items 1 to 22 and a back frame is attached to the second arm of the angle adjuster.

Effects of the Invention

The present invention exerts the following effects.

In the angle adjuster of the abovementioned item (1), the winding-and-tightening force of the winding-and-tightening member acts on the outer peripheral surface of the rotation shaft portion, eliminating the use of the fixed boss portion of the first arm of the angle adjuster as disclosed in the abovementioned Japanese Unexamined Patent Application Publication No. 2009-45395, which in turn enables the reduction of the size (thinning) of the angle adjuster.

Furthermore, since one end portion and the other end portion of the winding-and-tightening member are provided at the first arm, it is not required to fix one end portion of the winding-and-tightening member to the rotation shaft portion. Therefore, the assembling operation of the angle adjuster can be performed easily.

Furthermore, the angle adjuster is configured to allow or prevent the rotation of the second arm by decreasing or increasing the winding-and-tightening force of the winding-and-tightening member, which enables employment of such a structure that the development angle of the second arm to the first arm is adjusted in a stepless manner.

In the abovementioned item (2), the winding-and-tightening member has spring elasticity in the winding-and-tightening direction and the loosening direction, which assuredly enables returning of the winding-and-tightening member deformed in the winding-and-tightening direction or the loosening direction to its initial position.

Furthermore, since the outer peripheral surface of the rotation shaft portion is wound and tightened at all times by the spring elastic force of the winding-and-tightening member, unexpected rotation of the second arm in the forward rotation direction can be prevented. Furthermore, when a load in the reverse rotation direction is applied to the second arm, the frictional force in the reverse rotation direction assuredly acts on the winding-and-tightening member, thereby making it possible to assuredly prevent the rotation of the second arm in the reverse rotation direction.

In the abovementioned item (3), a frictional force in the forward rotation direction assuredly acts on the winding-and-tightening member in the loosening direction to thereby assuredly allow the rotation of the second arm in the forward rotation direction, and a frictional force in the reverse rotation direction assuredly acts on the winding-and-tightening member in the winding-and-tightening direction to thereby assuredly prevent the rotation of the second arm in the reverse rotation direction.

In the aforementioned item (4), the second fixed position is arranged within a range of ±45° with respect to the reference line centering the central position of the winding-and-tightening portion, a frictional force in the forward rotation direction further assuredly acts on the winding-and-tightening member in the loosening direction to thereby further assuredly allow the rotation of the second arm in the forward rotation direction. Furthermore, the frictional force in the reverse rotation direction further assuredly acts on the winding-and-tightening member in the winding-and-tightening direction to thereby further assuredly prevent the rotation of the second arm in the reverse rotation direction.

In the abovementioned item (5), the second fixed position is arranged within a range of 0° to 45° to a downstream side in the reverse rotation direction of the rotation shaft portion of the second arm with respect to the reference line centering the central position of the winding-and-tightening portion, and therefore a frictional force in the reverse rotation direction more assuredly acts on the winding-and-tightening member in the winding-and-tightening direction to thereby further assuredly prevent the rotation of the second arm in the reverse rotation direction.

In the abovementioned item (6), since the winding-and-tightening member is formed separately from the first arm, the winding-and-tightening member can be easily produced.

In the abovementioned item (7), since one end portion and the other end portion of the winding-and-tightening member are pivotally fixed to the first arm, the winding-and-tightening member assuredly operates in the winding-and-tightening direction and the loosening direction to thereby assuredly prevent or allow the rotation of the second arm in the predetermined rotation direction.

In the abovementioned item (8), since the winding-and-tightening member is formed by punching out a blank metal plate along an outer shape of the winding-and-tightening member in a thickness direction of the blank metal plate, the winding-and-tightening member can be easily produced.

Furthermore, the winding-and-tightening member has spring elasticity in the winding-and-tightening direction and the loosening direction, and therefore the winding-and-tightening member deformed in the winding-and-tightening direction or the loosening direction can be assuredly returned to the initial position.

In the abovementioned item (9), the inner peripheral surface of the winding-and-tightening portion of the winding-and-tightening member is in contact with the outer peripheral surface of the rotation shaft portion in a region of 180° or more centering the axial center position of the rotation shaft portion, to thereby assuredly prevent the rotation shaft portion from detaching from the winding-and-tightening portion.

In the abovementioned item (10), since the inner peripheral surface of the winding-and-tightening portion of the winding-and-tightening member is formed into a shape corresponding to the shape of the outer peripheral surface of the rotation shaft portion, the contact area between the inner peripheral surface of the winding-and-tightening portion and the outer peripheral surface of the rotation shaft portion can be increased. Therefore, a frictional force in the reverse rotation direction needed to prevent the rotation of the second arm in the reverse rotation direction can be obtained without increasing the diameter of the rotation shaft portion. As a result, the angle adjuster can be reduced in size.

In the abovementioned item (11), since the angle adjuster includes a control means for controlling an amount of deformation in the winding-and-tightening direction of the winding-and-tightening member, the plastic deformation of the winding-and-tightening member due to the deformation of the winding-and-tightening member exceeding the elastic deformation range of the winding-and-tightening member in the winding-and-tightening direction can be prevented to thereby assuredly return the winding-and-tightening member to its initial state.

In the abovementioned item (12), the plastic deformation of the winding-and-tightening member can be assuredly prevented.

In the abovementioned item (13), since the winding-and-tightening member and the rotation shaft portion are arranged between both outer plate portions, the winding-and-tightening member and the rotation shaft portion can be protected by both outer plate portions so that the winding-and-tightening member and the rotation shaft portion can operate normally. Furthermore, since both outer plate portions are connected to each other via a control member constituted by a rivet, both outer plate portions are prevented from being deformed in the developing direction by the control member, therefore, it is possible to assuredly protect the winding-and-tightening member and the rotation shaft portion by both outer plate portions.

In the abovementioned item (14), the plastic deformation of the winding-and-tightening member due to the deformation of the winding-and-tightening member exceeding the elastic deformation range of the winding-and-tightening member in the loosening direction can be prevented.

In the abovementioned item (15), since the first arm is provided with a stopper portion for stopping a rotation of the second arm in the forward rotation direction by being brought into contact with the second arm maximally rotated in the forward rotation direction, the second arm can be assuredly stopped at the maximally rotated position in the forward rotation direction.

In the abovementioned item (16), the prevention of the rotation of the second arm in the reverse rotation direction can be released by the release means.

In the abovementioned item (17), since the rotation plate portion is provided with a first pushing portion for pushing a pressing member arranged at a non-pressing position to a pressing position when the second arm maximally rotates in the forward rotation direction, the pressing member can be arranged at the pressing position by maximally rotating the second arm in the forward rotation direction. Therefore, the operation to release the prevention of rotation of the second arm in the reverse rotation direction can be easily performed.

In the abovementioned item (18), since the rotation plate portion is provided with a second pushing portion for pushing the pressing member arranged at the pressing position to the non-pressing position when the second arm maximally rotates in the reverse rotation direction, the pressing member can be arranged at the non-pressing position by maximally rotating the second arm in the reverse rotation direction. Therefore, the operation to return the second arm to the original state can be easily performed.

In the abovementioned item (19), the prevention of rotation of the second arm in the reverse rotation direction can be assuredly released, and the second arm can be assuredly returned to its original state.

In the abovementioned item (20), the same effects as those of the abovementioned item (19) can be exerted. Furthermore, the pressing member is arranged so as to bridge both the outer peripheral surfaces of sections of both the other end portion sides of both the winding-and-tightening portions of both the winding-and-tightening members, so the pressing member can be moved steadily between the pressing position and the non-pressing position. Therefore, the position of the pressing member can be smoothly switched between the pressing position and the non-pressing position and the detachment of the pressing member can be prevented.

In the abovementioned item (21), the winding-and-tightening member can be covered by a cover member so that the winding-and-tightening member operates normally. Furthermore, since the cover member is attached to the angle adjuster in a detachable manner, the operation to attach the cover member can be performed easily.

In the abovementioned item (22), the fitting shaft portion of the second arm is fitted in the engaging hole of the rotation shaft portion in a detachable manner. Therefore, by detaching the fitting shaft portion from the engaging hole, rotating the fitting shaft portion with respect to the engaging hole, and then fitting the fitting shaft portion into the engaging hole again, the starting development angle and the ending development angle of the second arm can be changed while maintaining the adjustable range of the development angle of the second arm.

In the reclining chair of the abovementioned item (23), the same effects as one of the effects of the abovementioned items (1) to (22) can be exerted in the angle adjuster.

EMBODIMENTS FOR CARRYING OUT THE INVENTION

Next, some embodiments of the present invention will be explained with reference to drawings.

FIGS. 1 to 14H are drawings for explaining an angle adjuster according to a first embodiment of the present invention.

Figure 1:
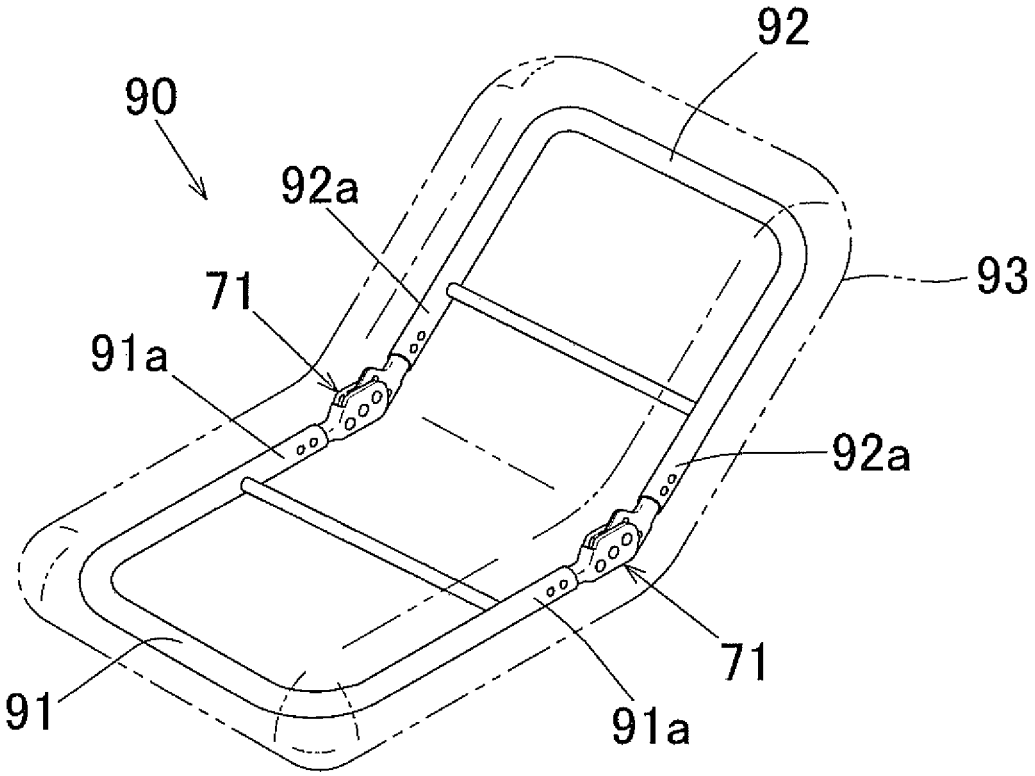
FIG. 1 is a perspective view showing a seat chair as a reclining chair to which an angle adjuster according to a first embodiment of the present invention is applied.

As shown in FIG. 1, the angle adjuster 71 of the first embodiment is used for adjusting the inclination angle of a back frame 92 of, e.g., the seat chair 90 as a reclining chair.

The back frame 92 of the seat chair 90 is made of a metal round pipe material. Also, a seat frame 91 of the seat chair 90 is also made of a metal round pipe material. The left and right rear end portions 91*a* of the seat frame 91 and the left and right lower end portions 92*a* of the back frame 92 are connected via a pair of left and right angle adjusters 71 and 71 of the first embodiment so that the inclination angle of the back frame 92 with respect to the seat frame 91 can be adjusted. In the meantime, the frames 91 and 92 are arranged inside a cushion body 93 (shown by dashed-two dot lines).

Figure 4:
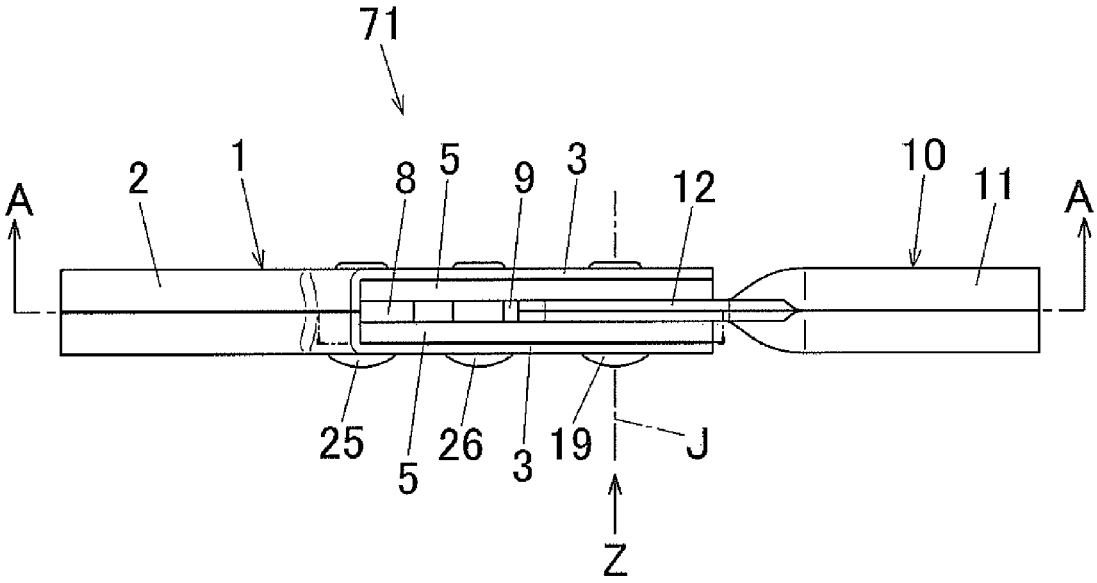
FIG. 4 is a plan view showing the angle adjuster.
Figure 5:
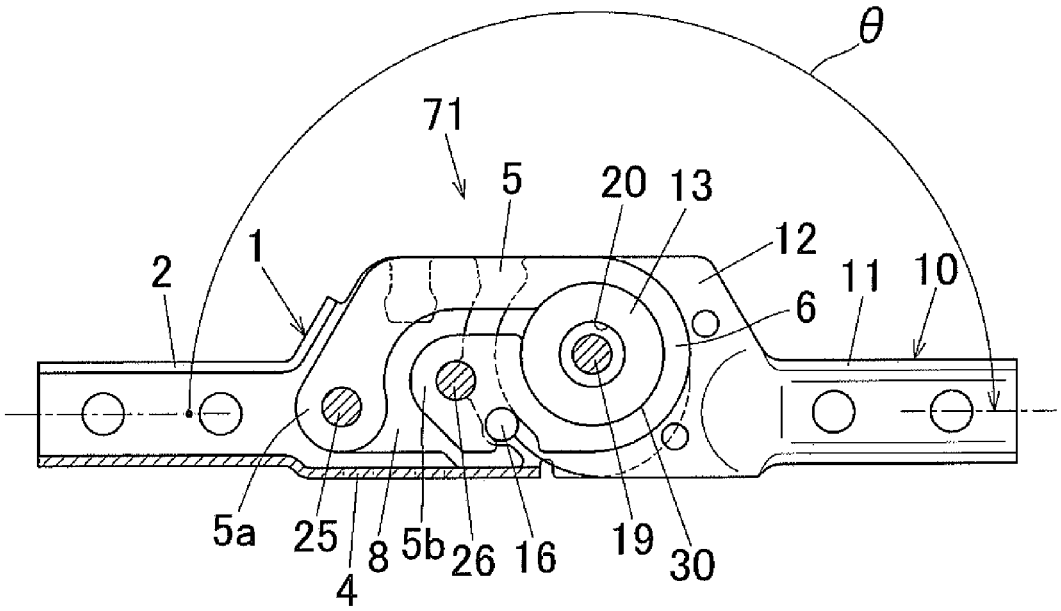
FIG. 5 is a cross-sectional view taken along the A-A line in FIG. 4.

The angle adjuster 71 is also referred to as an angle adjustment fitting and is equipped with a first arm 1 and a second arm 10 as shown in FIGS. 2 to 6. The first arm 1 and the second arm 10 are made from metal, more specifically, e.g., steel. The first arm 1 and the second arm 10 are connected so that the second arm 10 is rotatable relative to the first arm 1 in both forward and reserve rotational directions within a range of a predetermined development angle θ. In FIG. 5, θ denotes a development angle of the second arm 10 with respect to the first arm 1. In the angle adjuster 71, the adjustable range of the development angle θ of the second arm 10 is set to, for example, about 80° to about 180 °.

The first arm 1 is equipped with an attaching portion 2 to be attached to the rear end portion 91*a* of the seat frame 91. The attaching portion 2 is pipe-shaped. Also, the attaching portion 2 is inserted into the hollow portion of the rear end portion 91*a* of the seat frame 91, and in that state, the rear end portion 91*a* of the seat frame 91 is attached to the attaching portion 2 by a plurality of rivets. Therefore, a plurality of rivet through-holes are punched and formed in the attaching portion 2.

Figure 2:
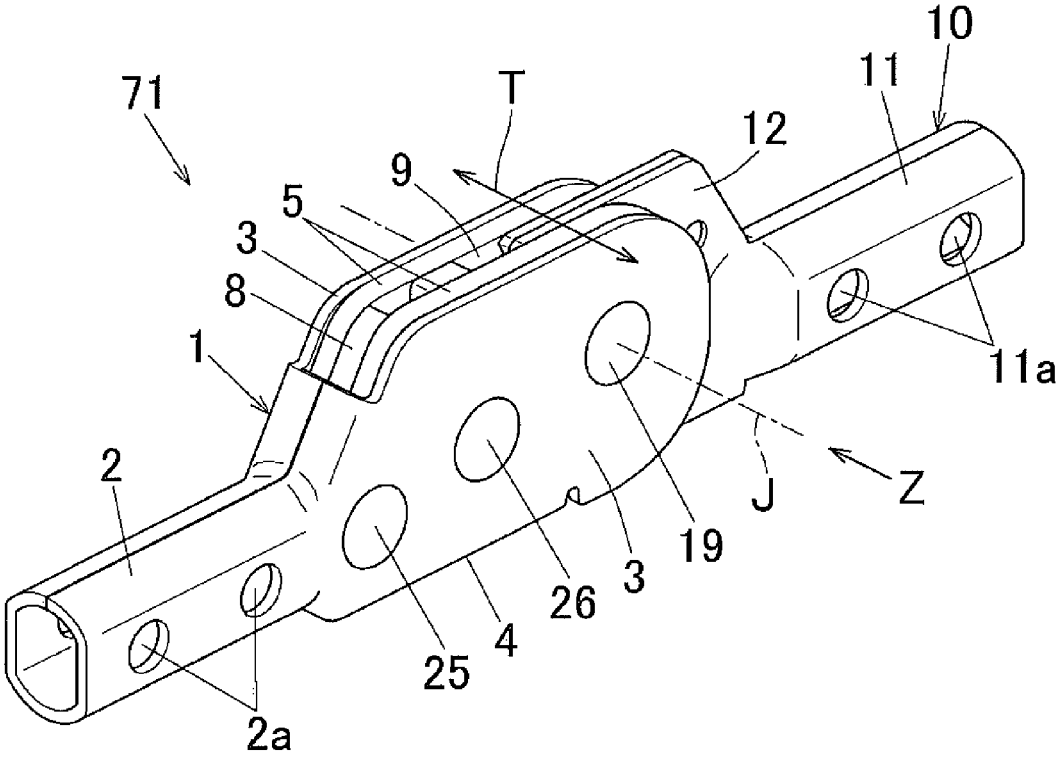
FIG. 2 is a perspective view showing the angle adjuster.
Figure 3:
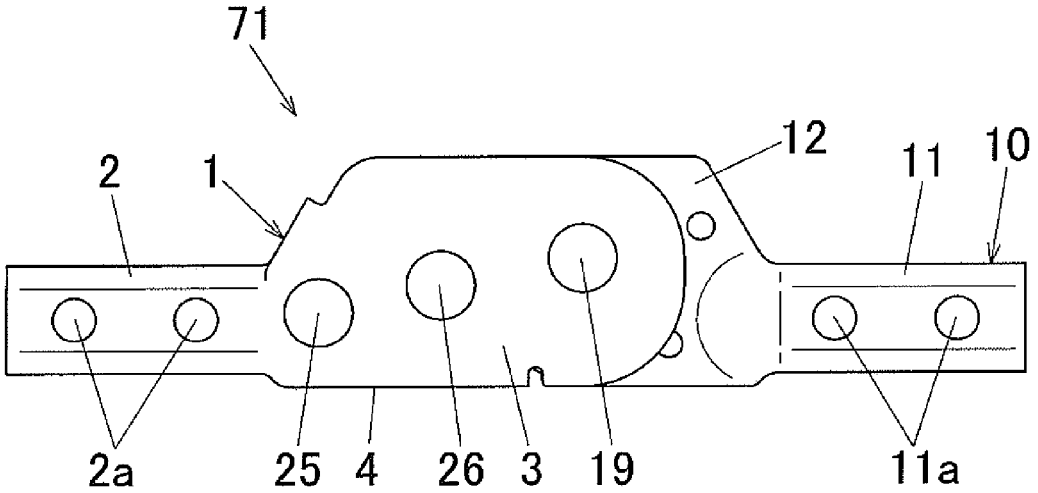
FIG. 3 is a side view showing the angle adjuster.
Figure 6:
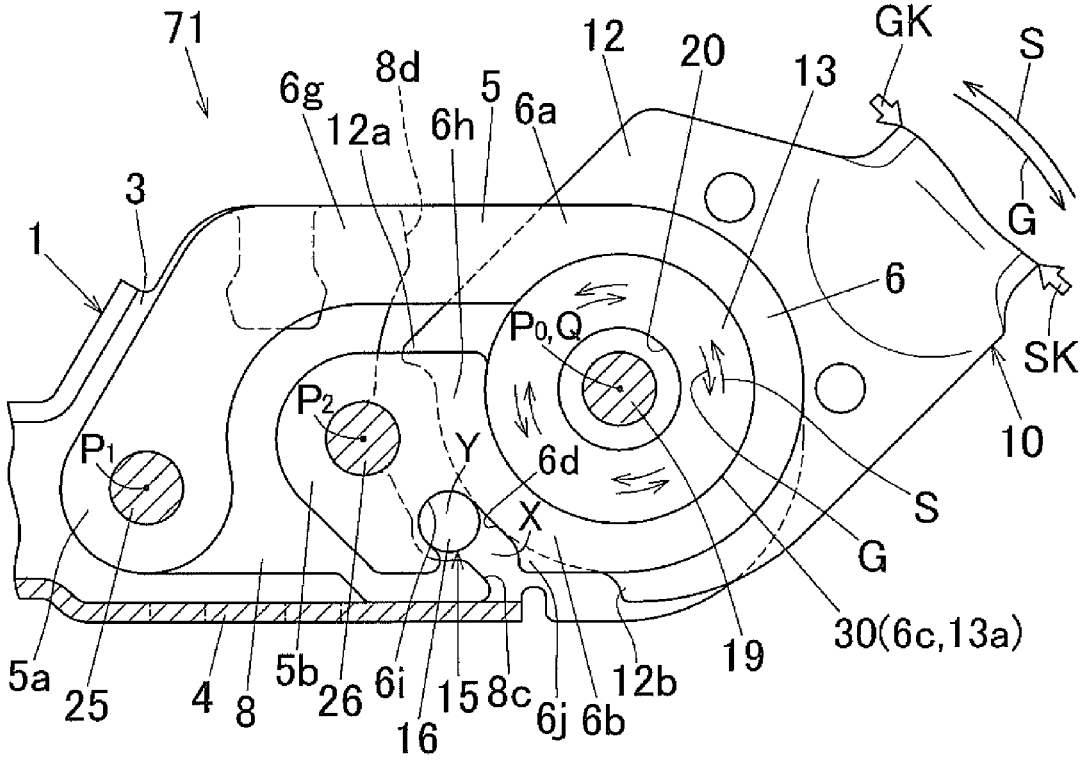
FIG. 6 is an enlarged cross-sectional view showing the angle adjuster.

At the base end portion of the attaching portion 2, a pair of outer plate portions 3 and 3 arranged apart from each other in an opposed manner and a bottom plate portion 4 connecting the bottom ends of both the outer plate portions 3 and 3 are integrally formed (see FIGS. 5 and 6.) In this embodiment, for the convenience of explanation, the direction in which both the outer plate portions 3 and 3 opposed each other is defined as a "left and right direction" of the angle adjuster 71. This direction matches the thickness direction T of the angle adjuster 71 as shown in FIG. 2 and further matches an axial direction of a rotation shaft portion 13 which will be described later.

Figure 9:
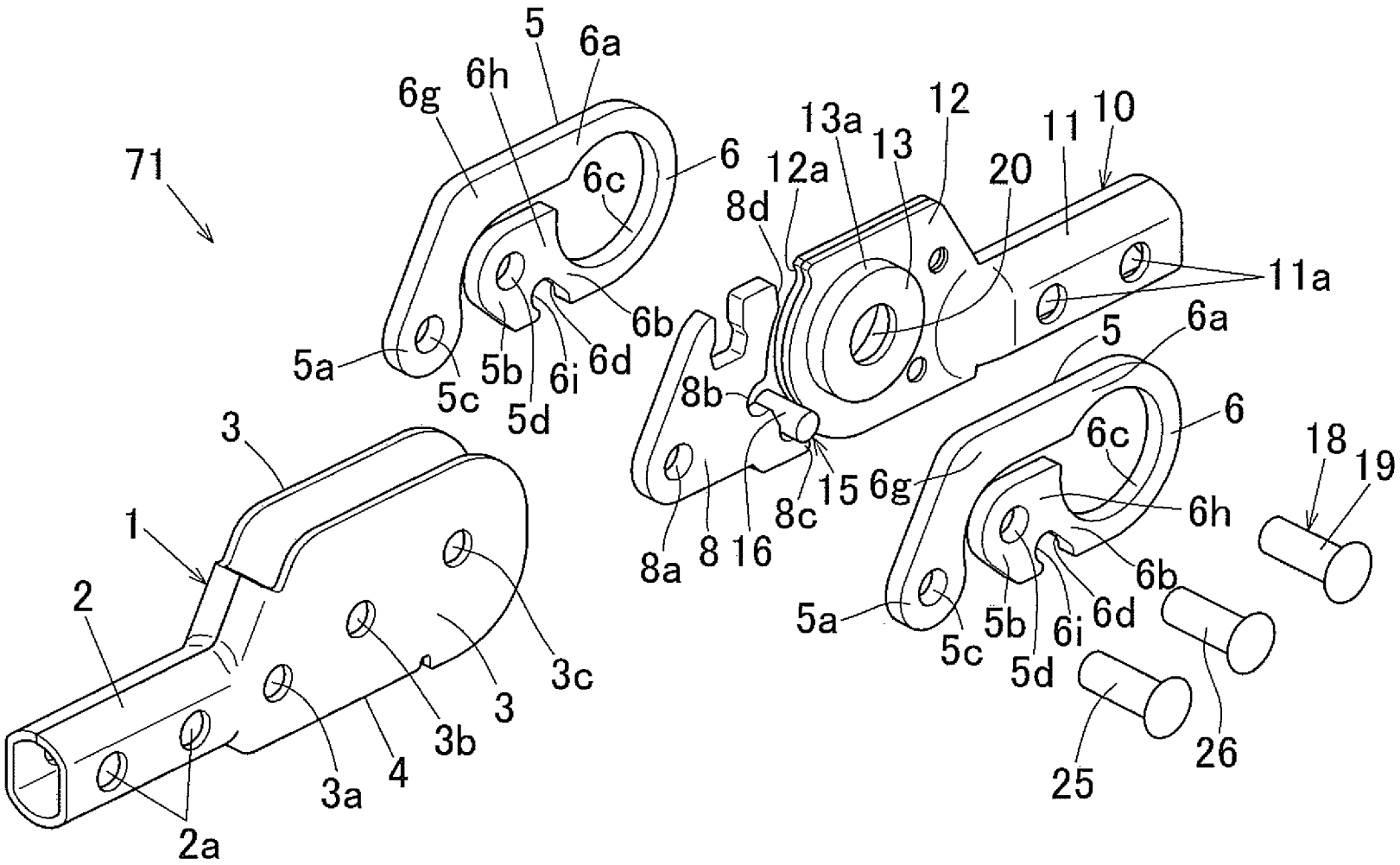
FIG. 9 is a perspective view showing the angle adjuster in a state during assembly.
Figure 10:
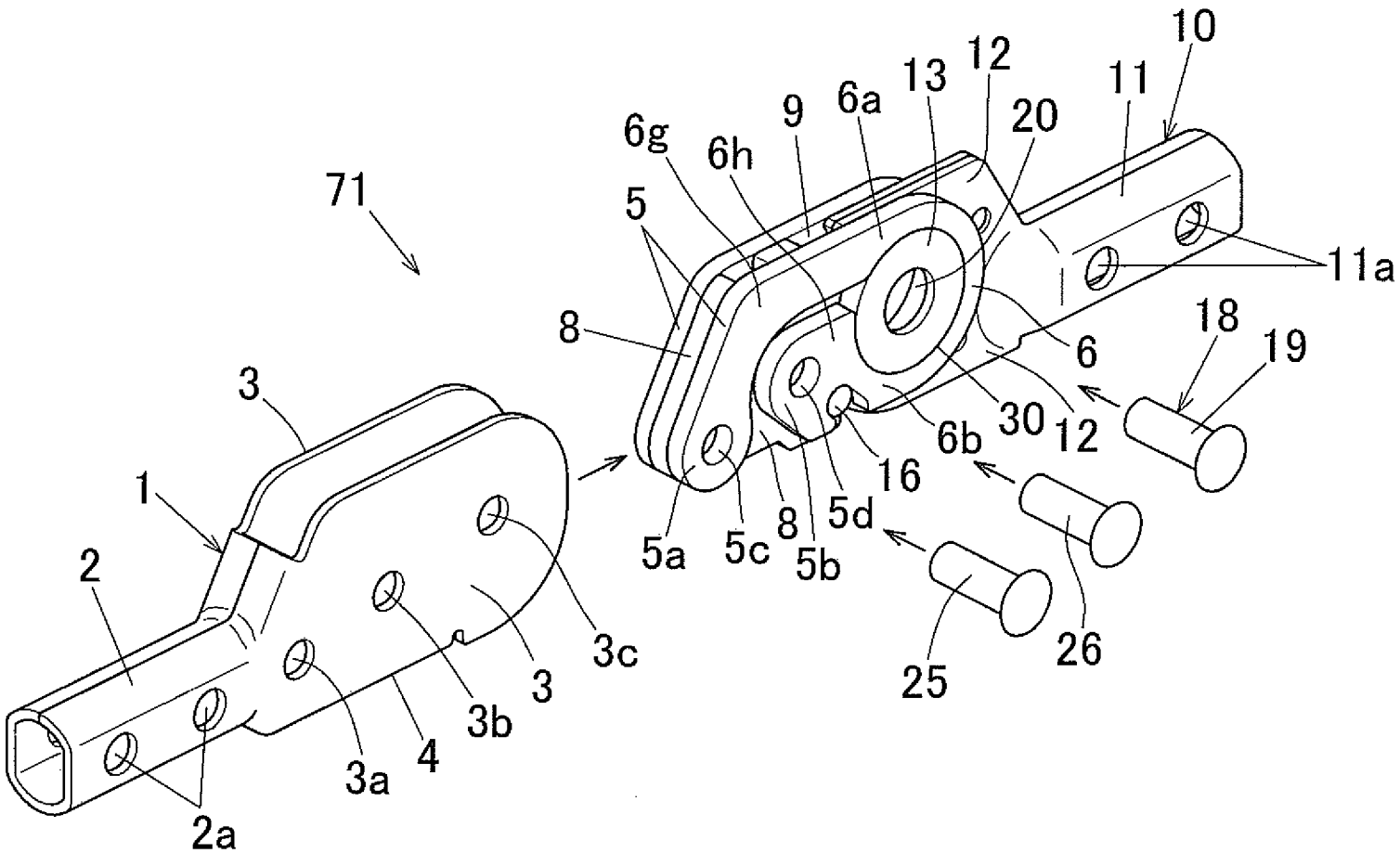
FIG. 10 is a perspective view further showing the angle adjuster in a state during assembly.
Figure 11:
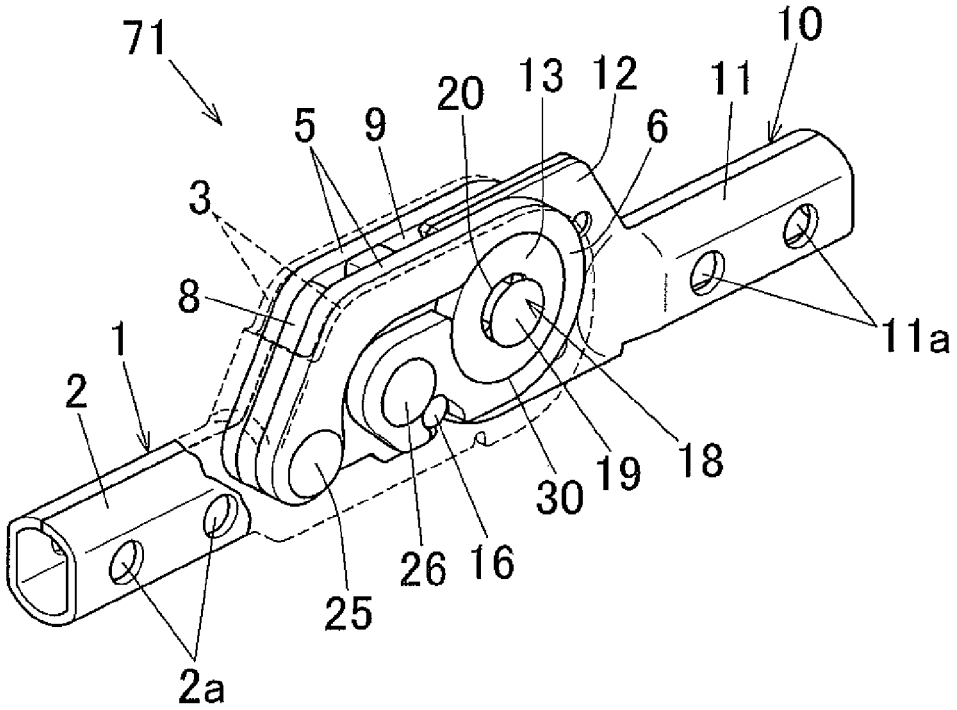
FIG. 11 is a partially cut-out perspective view showing of the angle adjuster.

Furthermore, the first arm 1, as shown in FIGS. 8 to 11, is equipped with a pair of left and right winding-and-tightening members 5 and 5 and a spacer member 8. The winding-and-tightening member 5 is formed separately from the first arm 1 and the spacer member 8. The spacer member 8 is formed separately from the first arm 1 and the winding-and-tightening member 5. Both the winding-and-tightening members 5 and 5 and the spacer member 8, as shown in FIGS. 4 and 11, are arranged between both the outer plate portions 3 and 3. The structures of these members will be explained later.

Figure 8:
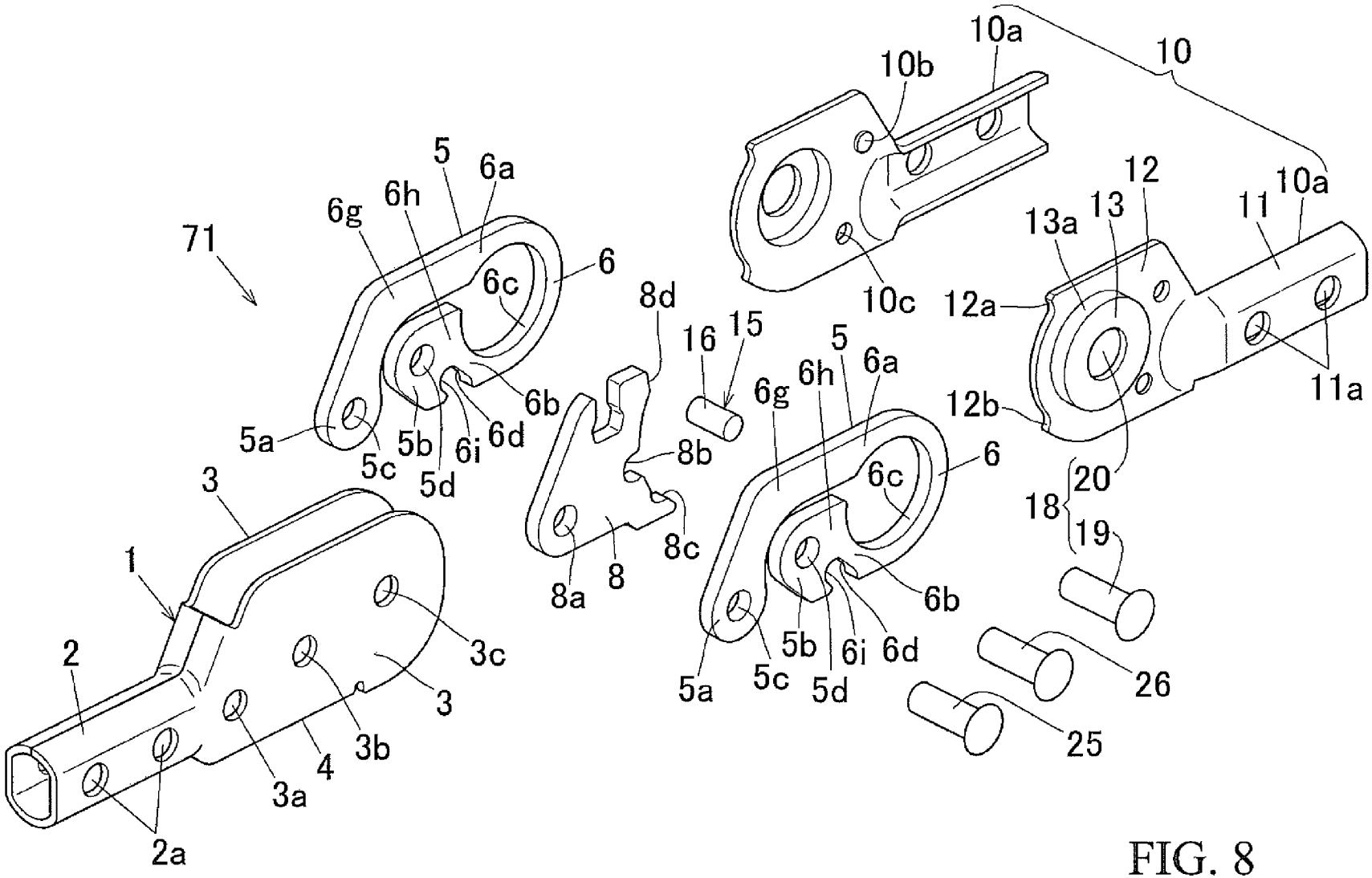
FIG. 8 is an exploded perspective view showing the angle adjuster.

The second arm 10 is, as shown in FIGS. 8 and 9, constituted by integrally assembling a pair of left and right second arm constituting pieces 10*a* and 10*a* to each other. As shown in FIG. 8, in a state before both constituting pieces 10*a* and 10*a* are assembled, the engagement protruded portion 10*b* and the engagement concave portion 10*c* capable of being engaged to each other to prevent the dislocation of both assembled constituting pieces 10*a* and 10*a* are each formed at the assembling face of each constituting piece 10*a*.

The second arm 10 is provided with an attaching portion 11 to be attached to the lower end portion 92*a* of the back frame 92. The attaching portion 11 is pipe-shaped. The attaching portion 11 is inserted into the hollow portion of the lower end portion 92*a* of the back frame 92 and in that state, the lower end portion 92*a* of the back frame 92 is attached to the attaching portion 11 by a plurality of rivets. Therefore, a plurality of rivet through-holes 11*a* are punched and formed in the attaching portion 11.

A rotation plate portion 12 is integrally formed on the base end portion of the attaching portion 11 and therefore, the rotation plate portion 12 is integrally provided at the second arm 10 in a rotatable manner. Furthermore, at approximately central portions of the rotation plate portions 12, protruded rotation shaft portions 13 are integrally formed on both sides of the thickness direction of the rotation plate portion 12 and therefore, the rotation shaft portion 13 is formed on the second arm 10 so as to rotate together with the second arm 10. The rotation shaft portion 13 is constituted by a boss portion having a circular shape in cross-section. An outer peripheral surface 13*a* of the rotation shaft portion 13 is formed as a circular arc surface centering the axis of the rotation shaft portion 13. The rotation shaft portion 13 is formed by locally press-bending the approximately central portion of the rotation plate portion 12.

In FIGS. 2 and 4, J denotes an axis line of the rotation shaft portion 13. Furthermore, in the angle adjuster 71, "as seen in the axial direction of the rotation shaft portion 13" denotes "as seen in the direction along the axis line J," i.e., "as seen in the direction of the arrow Z."

In the first arm 1, as shown in FIGS. 8 and 9, a pair of left and right winding-and-tightening members 5 and 5 are the same in shape and dimension. Each winding-and-tightening member 5 is made of metal and has spring elasticity. The spacer member 8 is for forming a gap 9 corresponding to the thickness of the rotation plate portion 12 between both the winding-and-tightening members 5 and 5, and has a plate shape. The material is metal such as steel. Both the winding-and-tightening members 5 and 5, as shown in FIGS. 10 and 11, are arranged in an opposed manner with the spacer member 8 sandwiched between both the winding-and-tightening members 5 and 5, and therefore the gap 9 by the spacer member 8 is formed between both the winding-and-tightening members 5 and 5. The rotation plate portion 12 of the second arm 10 is arranged in the gap 9.

As shown in FIG. 6, as seen in the axial direction of the rotation shaft portion 13, one end portion 5*a* and the other end portion 5*b* of each winding-and-tightening member 5 is pivotally fixed to both the outer plate portions 3 and 3 of the first arm 1 so as to be arranged distantly with each other in a rotatable manner via a first rivet 25 and a second rivet 26. With this, one end portion 5*a* and the other end portion 5*b* of each winding-and-tightening member 5 and 5 are positionally fixed to both the outer plate portions 3 and 3 of the first arm 1.

That is, as shown in FIGS. 8 and 9, in one end portion 5*a* of each winding-and-tightening member 5, the end portion of the spacer member 8 and each outer plate portion 3, through-holes 5*c*, 8*a* and 3*a* for the first rivet 25 are formed. Hereinafter, these though-holes will be referred to as "first insertion hole." The cross-sectional shape of each first insertion hole 5*c*, 8*a* and 3*a* is circular. As shown in FIGS. 9 and 10, the first rivet 25 having a circular cross-sectional shape is inserted into the first insertion holes 5*c*, 8*a* and 3*a* and the tip end portion is crushed into a large diameter shape. With this, as shown in FIG. 6, one end portions 5*a* and 5*a* of both the winding-and-tightening members 5 and 5 are pivotally fixed to both the outer plate portions 3 and 3 via the first rivet 25, and the spacer member 8, both the winding-and-tightening members 5 and 5, and both the outer plate portions 3 and 3 are connected via the first rivet 25. Furthermore, as shown in FIGS. 8 and 9, in the other end portion 5*b* of each winding-and-tightening member 5 and each outer plate portion 3, through-holes 5*d* and 3*b* for the second rivet 26 are formed. Hereinafter, these through-holes will be referred to as "second insertion holes." Each second insertion hole 5*d* and 3*b* has a circular cross-sectional shape. An insertion concave portion 8*b* for the second rivet 26 is formed on the outer peripheral edge of the spacer member 8 on the rotation shaft portion 13 side. As shown in FIG. 10, the second rivet 26 having a circular cross-sectional shape is inserted into the second insertion holes 5*d* and 3*b* and insertion concave portion 8*b*, and the tip end portion is crushed into a large diameter shape. With this, as shown in FIG. 6, the other end portions 5*b* and 5*b* of both the winding-and-tightening members 5 and 5 are pivotally fixed to both the outer plate portions 3 and 3 via the second rivet 26. The spacer member 8, both the winding-and-tightening members 5 and 5, and both the outer plate portions 3 and 3 are connected via the second rivet 26. Therefore, the spacer member 8 is attached to both the outer plate portions 3 and 3 (that is, the first arm 1) by the first and second rivets 25 and 26 in a fixed manner.

Furthermore, as shown in FIG. 9, a winding-and-tightening portion 6 (winding portion) curved in a circular arc shape is formed at a portion between one end portion 5*a* and the other end portion 5*b* of each winding-and-tightening member 5. As shown in FIGS. 10 and 11, inside both the winding-and-tightening portions 6, the rotation shaft portion 13 of the second arm 10 is arranged in a pressed-fitted and rotatable manner. In this way, the rotation shaft portion 13 is arranged inside the winding-and-tightening portion 6, so that the winding-and-tightening portion 6 of the winding-and-tightening member 5 is in a state in which the winding-and-tightening portion 6 is wound on the outer peripheral surface 13*a* of the rotation shaft portion 13. As shown in FIG. 6, the first arm 1 and the second arm 10 are connected so that the second arm 10 is rotatable relative to the first arm 1 about the rotation shaft portion 13 within the predetermined development angle θ (for example, θ=about 80° to about 180) ° in both forward and reserve rotational directions S and G. In the first embodiment, for the convenience of explanation, the rotation direction in which the development angle θ of the second arm 10 with respect to the first arm 1 becomes smaller is referred to as "forward rotation direction S" and the opposite rotation direction is referred to as "reverse rotation direction G."

Figure 7A:
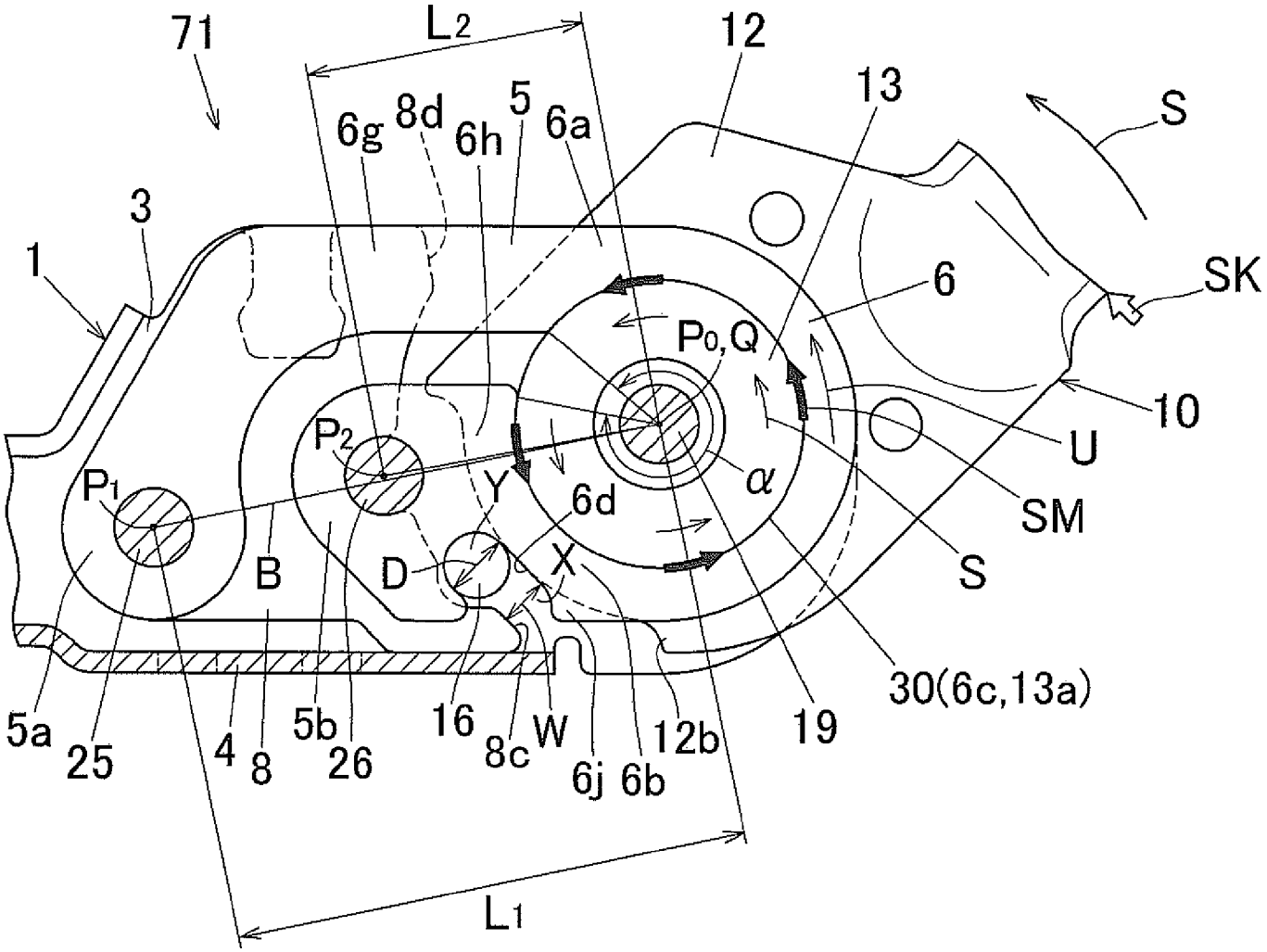
FIG. 7A is an enlarged cross-sectional view for explaining a force which acts at the time of a rotational movement of the second arm of the angle adjuster in the forward rotation direction.

Here, as shown in FIG. 7A, in this embodiment, for the convenience of explanation, some portions will be referred to as follows. When seen in the axial direction of the rotation shaft portion 13, the pivot position of the one end portion 5*a* of the winding-and-tightening member 5 to the first arm 1 (specifically, outer plate portion 3 of the first arm 1) as a fixed position will be referred to as a first pivot position P1. The pivot position of the other end portion 5*b* of the winding-and-tightening member 5 to the first arm 1 (specifically, the outer plate portion 3 of the first arm 1) as a fixed position will be referred to as a second pivot position P2. The straight-line distance between the first pivot position P1 and the central position P0 of the winding-and-tightening portion 6 of the winding-and-tightening member 5 will be referred to as a first distance L1. The straight-line distance between the second pivot position P2 and the central position P0 of the winding-and-tightening portion 6 of the winding-and-tightening member 5 will be referred to as a second distance L2.

In FIG. 7A, "Q" denotes an axial center position of the rotation shaft portion 13. In this embodiment, "Q" coincides with the central position P0 of the winding-and-tightening portion 6.

As shown FIG. 7A, the second distance L2 is set to be shorter than the first distance L1 (that is, L2<L1).

Furthermore, the second pivot position P2 is arranged on the central position P0 side of the winding-and-tightening portion 6 with respect to the first pivot position P1 and arranged on the first pivot position P1 side with respect to the central position P0 of the winding-and-tightening portion 6. That is, the second pivot position P2 is arranged between the first pivot position P1 and the central position P0 of the winding-and-tightening portion 6.

Here, the portion between the winding-and-tightening portion 6 and the one end portion 5*a* of the winding-and-tightening member 5 is called "long side portion 6*g*" of the winding-and-tightening member 5, and the portion between the winding-and-tightening portion 6 and the other end portion 5*b* of the winding-and-tightening member 5 is called "short side portion 6*h*" of the winding-and-tightening member 5. As seen in the axial direction of the rotation shaft portion 13, the long side portion 6*g* and the short side portion 6*h* are arranged in a separate manner.

Furthermore, each winding-and-tightening member 5 is entirely arranged so as to be in parallel to a plane perpendicular to the axis line J of the rotation shaft portion 13.

Figure 7B:
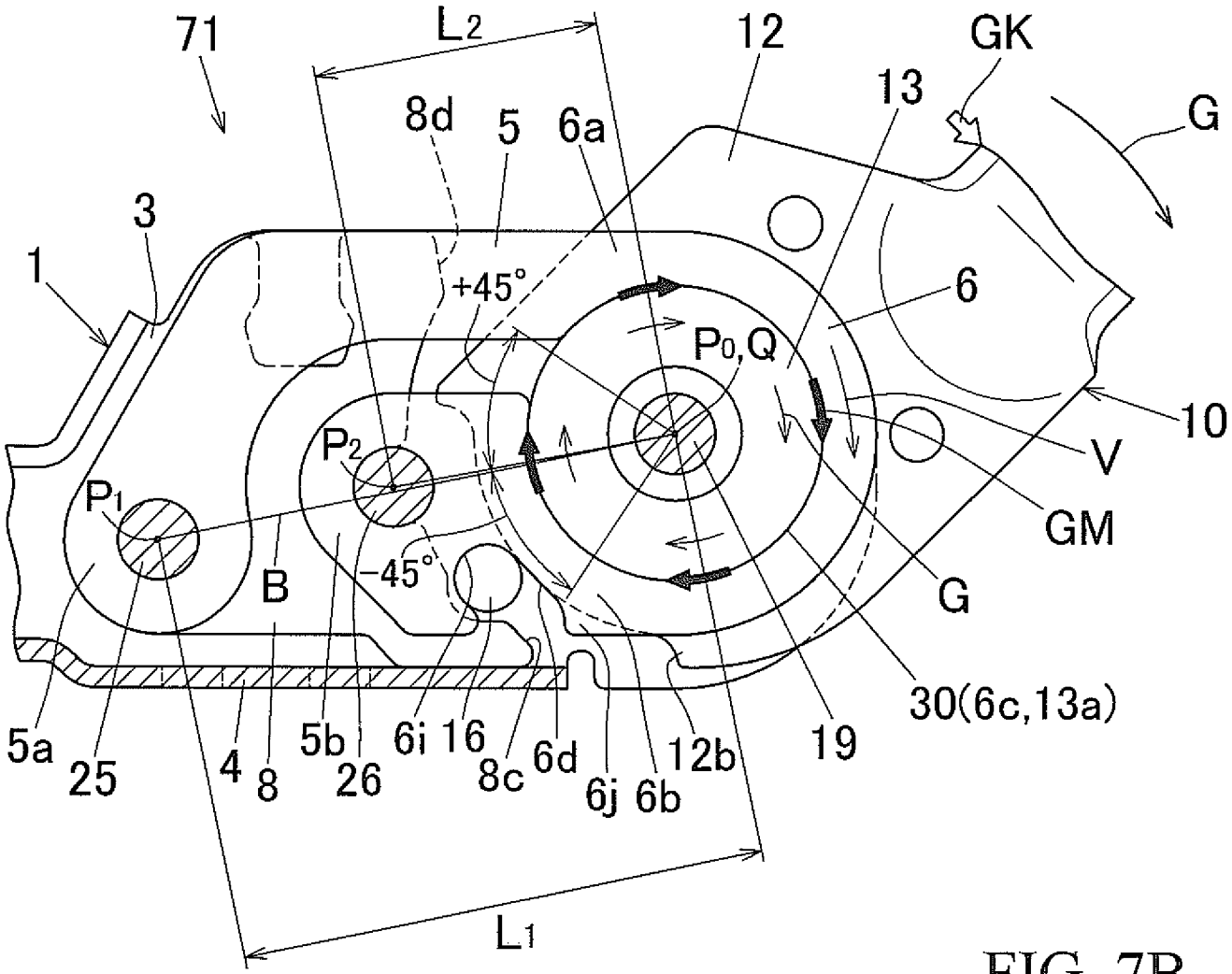
FIG. 7B is an enlarged cross-sectional view for explaining a force which acts at the time of a rotational movement of the second arm of the angle adjuster in the reverse rotation direction.

In the angle adjuster 71 in a state as shown in FIGS. 7A and 7B, the development angle θ of the second arm 10 with respect to the first arm 1 (see FIG. 5) is set to about 135°. Therefore, the second arm 10 is arranged within a range capable of adjusting the development angle θ of the second arm 10.

In the angle adjuster 71 in a state as shown in FIG. 7A, when a load SK is applied to the second arm 10 in the forward rotation direction S, the angle adjuster 71 is configured to allow the rotation of the second arm 10 in the forward rotation direction S.

That is, as shown in FIG. 7A, when a load SK is applied to the second arm 10 in the forward rotation direction S, the second arm 10 is urged to rotate in the forward rotation direction S centering the rotation shaft portion 13 of the second arm 10. In accordance with such a rotational movement in the forward rotation direction S, a frictional force SM in the forward rotation direction S is generated at the contact portion 30 between the outer peripheral surface 13*a* of the rotation shaft portion 13 and the inner peripheral surface 6*c* of the winding-and-tightening portion 6 of the winding-and-tightening member 5. The frictional force SM acts on the winding-and-tightening member 5 (specifically, the winding-and-tightening portion 6 of the winding-and-tightening member 5) in the loosening direction U with respect to the outer peripheral surface 13*a* of the rotation shaft portion 13. As a result, due to this frictional force SM, the winding-and-tightening member 5 (specifically, the winding-and-tightening portion 6 of the winding-and-tightening member 5) slightly deforms elastically in the loosening direction U with the first pivot position P1 and the second pivot position P2 as the fixed ends (specifically, rotation ends) so that the inner diameter of the winding-and-tightening portion 6 increases. With this, the winding-and-tightening force of the winding-and-tightening member 5 to the outer peripheral surface 13*a* of the rotation shaft portion 13 decreases, thereby allowing the rotation of the second arm 10 in the forward rotation direction S.

On the other hand, in the angle adjuster 71 in a state as shown in FIG. 7B, when a load GK is applied to the second arm 10 in the reverse rotation direction G, the angle adjuster 71 is configured to prevent the rotation of the second arm 10 in the reverse rotation direction G.

That is, as shown in FIG. 7B, when a load GK is applied to the second arm 10 in the reverse rotation direction G, the second arm 10 is urged to rotate in the reverse rotation direction G centering the rotation shaft portion 13 of the second arm 10. Due to such a rotational movement in the reverse rotation direction G, a frictional force GM in the reverse rotation direction G is generated at the contact portion 30 between the outer peripheral surface 13*a* of the rotation shaft portion 13 and the inner peripheral surface 6*c* of the winding-and-tightening portion 6 of the winding-and-tightening member 5. The frictional force GM acts on the winding-and-tightening member 5 (specifically, the winding-and-tightening portion 6 of the winding-and-tightening member 5) in the winding-and-tightening direction V with respect to the outer peripheral surface 13*a* of the rotation shaft portion 13. As a result, due to this frictional force GM, the winding-and-tightening member 5 (specifically, the winding-and-tightening portion 6 of the winding-and-tightening member 5) elastically deforms slightly in the winding-and-tightening direction V with the first pivot position P1 and the second pivot position P2 as the fixed ends (specifically, rotation ends) so that the inner diameter of the winding-and-tightening portion 6 decreases. With this, the winding-and-tightening force of the winding-and-tightening member 5 to the outer peripheral surface 13*a* of the rotation shaft portion 13 increases. As a result, the rotation of the second arm 10 in the reverse rotation direction G is prevented.

Furthermore, the forward rotation direction S of the second arm 10 is, as shown in FIG. 7A, set in the rotation direction of unwinding the first pivot position side portion 6*a* of the winding-and-tightening portion 6 of the winding-and-tightening member 5 from the outer peripheral surface 13*a* of the rotation shaft portion 13. On the other hand, the reverse rotation direction G of the second arm 10 is, as shown in FIG. 7B, set in the rotation direction of winding the first pivot position side portion 6*a* of the winding-and-tightening portion 6 of the winding-and-tightening member 5 on the outer peripheral surface 13*a* of the rotation shaft portion 13. By setting the rotation directions S and G of the second arm 10 as mentioned above, when the load SK in the forward rotation direction S is applied to the second arm 10, the frictional force SM in the forward rotation direction S assuredly acts on the winding-and-tightening member 5 in the loosening direction U, which in turn assuredly allows the rotation of the second arm 10 in the forward rotation direction S. Further, when the load GK in the reverse rotation direction G is applied to the second arm 10, the frictional force GM in the reverse rotation direction G assuredly acts on the winding-and-tightening member 5 in the winding-and-tightening direction V, which in turn assuredly prevents the rotation of the second arm 10 in the reverse rotation direction G. In the meantime, the first pivot position side portion 6*a* of the winding-and-tightening portion 6 of the winding-and-tightening member 5 denotes the same portion as one end portion side portion of the winding-and-tightening portion 6 of the winding-and-tightening member 5.

Here, the winding-and-tightening member 5 has spring elasticity in the winding-and-tightening direction V and the loosening direction U. With this, even in cases where the winding-and-tightening member 5 (specifically, winding-and-tightening portion 6 of the winding-and-tightening member 5) deforms in the winding-and-tightening direction V or the loosening direction U, the winding-and-tightening member 5 (specifically, the winding-and-tightening portion 6 of the winding-and-tightening member 5) is urged to return to its initial position (initial state) by its own spring elastic force.

Furthermore, in the angle adjuster 71, in a state in which the winding-and-tightening portion 6 of the winding-and-tightening member 5 is wound on the outer peripheral surface 13*a* of the rotation shaft portion 13, the outer peripheral surface 13*a* of the rotation shaft portion 13 is wound and tightened consistently by the spring elastic force of the winding-and-tightening member 5. A method for realizing such a state will be explained below with reference to FIGS. 13A and 13B.

Figure 13A:
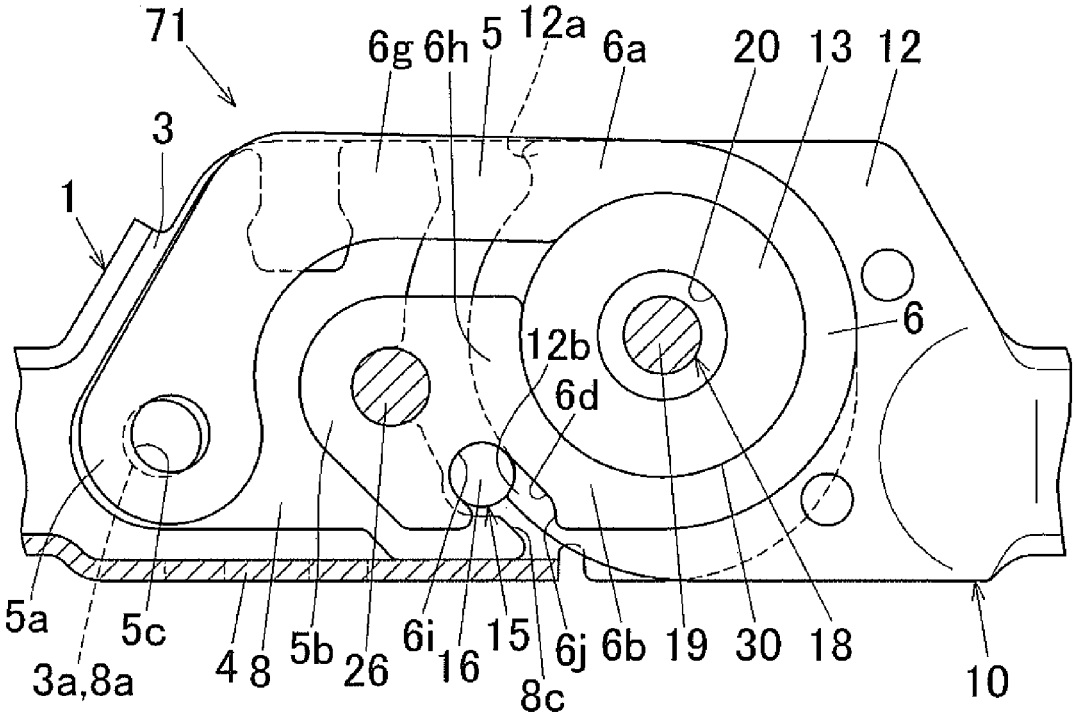
FIG. 13A is an enlarged cross-sectional view showing a state before one end portion of the winding-and-tightening member of the angle adjuster is pivotally fixed to the first arm.

In FIG. 13A, the other end portions 5*b* of each winding-and-tightening member 5 is pivotally fixed to both the outer plate portions 3 and 3 of the first arm 1 via the second rivet 26. On the other hand, the one end portion 5*a* of each winding-and-tightening member 5 is not yet pivotally fixed to both the outer plate portions 3 and 3 of the first arm 1. The first insertion hole 5*c* of the one end portion 5*a* of each winding-and-tightening member 5 is arranged slightly dislocated toward the second rivet 26 side than the first insertion hole 8*a* of the spacer member 8 and the first insertion hole 3*a* of each outer plate portion 3. In this state, the rotation shaft portion 13 is not closely arranged to the inside of the winding-and-tightening portion 6 of each winding-and-tightening member 5. In other words, the outer peripheral surface 13*a* of the rotation shaft portion 13 is not tightly wound by each winding-and-tightening member 5.

Figure 13B:
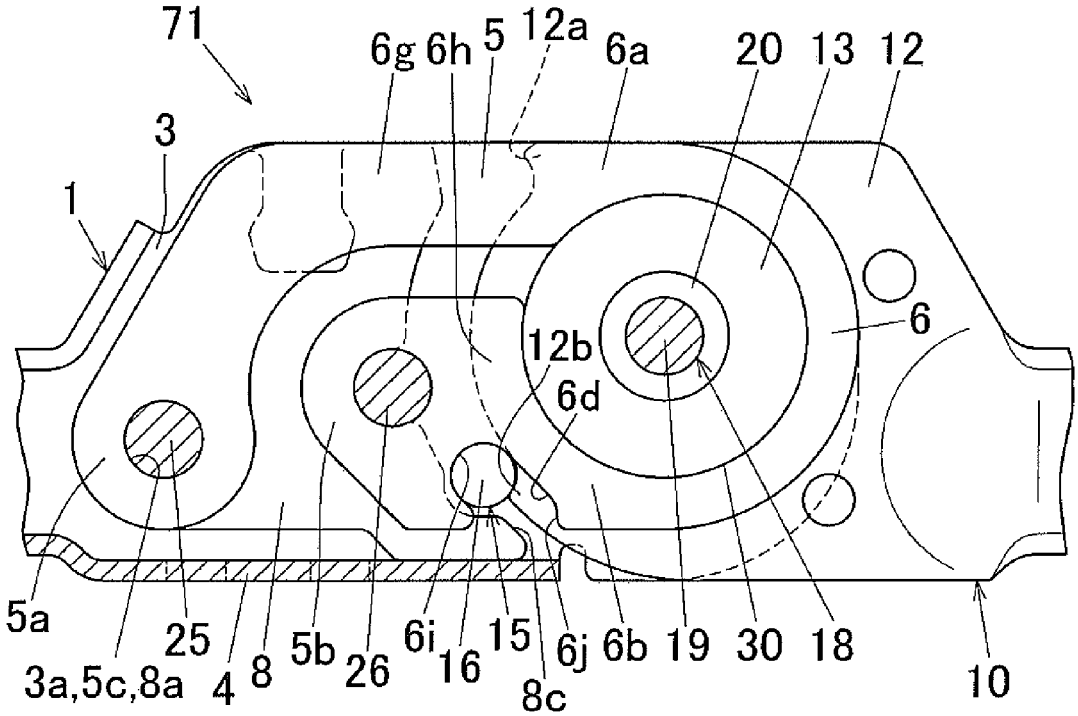
FIG. 13B is an enlarged cross-sectional view showing a state after one end portion of the winding-and-tightening member of the angle adjuster is pivotally fixed to the first arm.

Next, in order to pivotally fix one end portion 5*a* of each winding-and-tightening member 5 to both the outer plate portions 3 and 3 of the first arm 1, while elastically deforming each winding-and-tightening member 5 so that the first insertion hole 5*c* of one end portion 5*a* of each winding-and-tightening member 5 aligns with the first insertion hole 8*a* of the spacer member 8 and the first insertion hole 3*a* of both the outer plate portions 3 and 3, the first rivet 25 is forcefully inserted into the first insertion holes 3*a*, 5*c* and 8*a*. By this, as shown in FIG. 13B, one end portion 5*a* of each winding-and-tightening member 5 is pivotally fixed to both the outer plate portions 3 and 3 via the first rivet 25, and the spring elastic force of each winding-and-tightening member 5 generated in accordance with the elastic deformation of each winding-and-tightening member 5, thereby brings the outer peripheral surface 13*a* of the rotation shaft portion 13 in a state in which the outer peripheral surface 13*a* is wound and tightened consistently by each winding-and-tightening member 5. By becoming this state, it becomes possible to prevent an unexpected rotation of the second arm 10 in the forward rotation direction S. Furthermore, when a load GK in the reverse rotation direction G is applied to the second arm 10, it is possible to make the frictional force GM in the reverse rotation direction G assuredly act on the winding-and-tightening member 5, which in turn makes it possible to assuredly prevent the rotation of the second arm 10 in the reverse rotation direction G.

Figure 12:
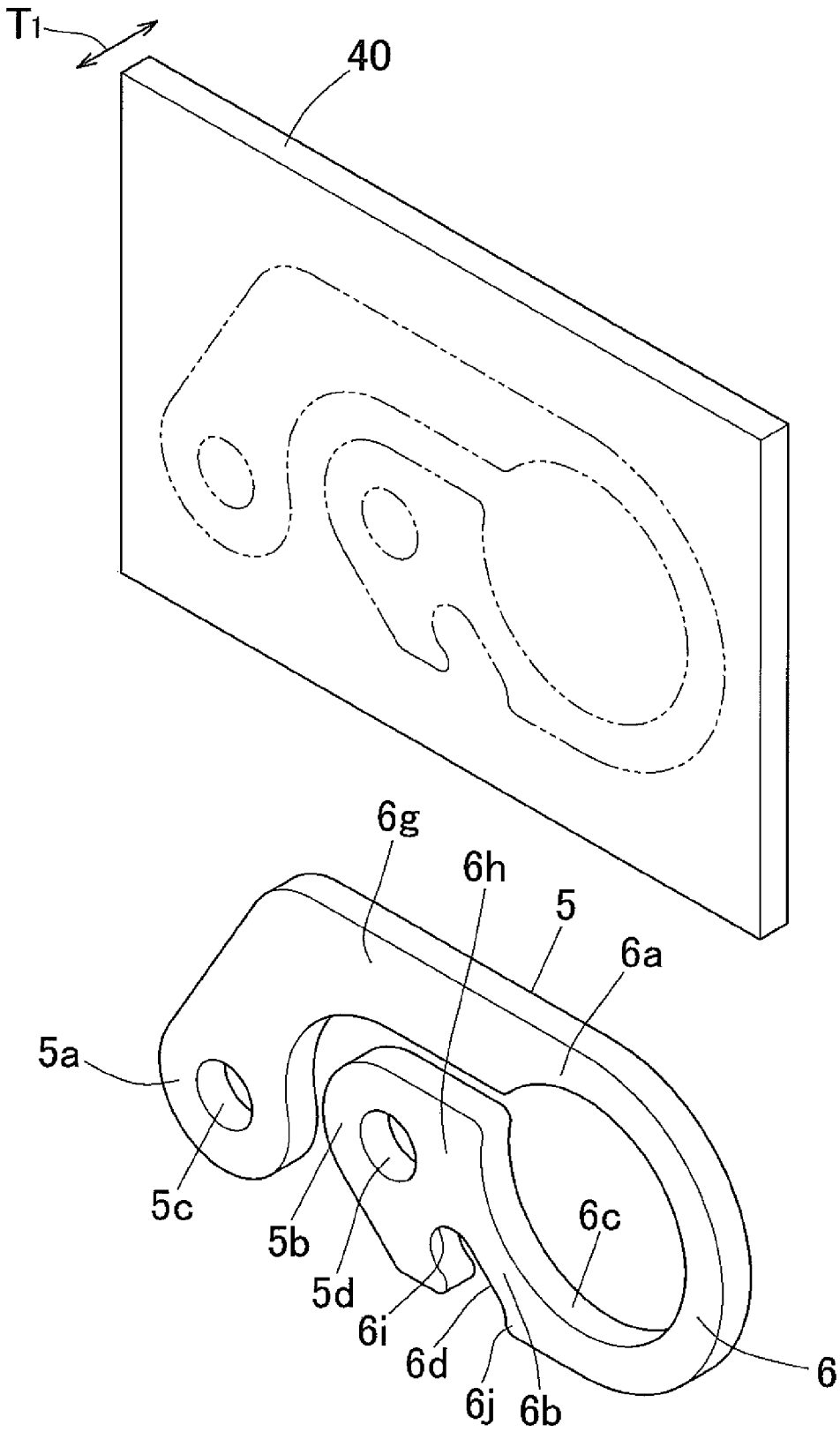
FIG. 12 is a perspective view of the winding-and-tightening member and the blank metal plate of the angle adjuster.

The winding-and-tightening member 5, as shown in FIG. 12, is made by punching out a flat blank metal plate 40 along an outer shape of the winding-and-tightening member 5 (shown by chain-line) in a thickness direction T1 of the blank metal plate 40 using a punch press device (now illustrated). Therefore, the winding-and-tightening member 5 can be made easily. Furthermore, the winding-and-tightening member 5 is subjected to quenching processing to increase the hardness. In this first embodiment, the blank metal plate 40 is made of a steel plate such as a spring steel plate and therefore, the winding-and-tightening member 5 has excellent spring elasticity in the winding-and-tightening direction V and the loosening direction U.

Furthermore, one end portion 5*a* and the other end portion 5*b* of the winding-and-tightening member 5 are pivotally fixed to the outer plate portions 3 of the first arm 1 so that the winding-and-tightening direction V and the loosening direction U of the winding-and-tightening member 5 is parallel to the surface of the blank metal plate 40. Therefore, the winding-and-tightening member 5 has strong spring elastic force (that is, a large spring constant). Therefore, a thin member can be used as the winding-and-tightening member 5, which assuredly enables downsizing (thinning) of the angle adjuster 71.

Here, as shown in FIG. 7B, as seen in the axial direction of the rotation shaft portion 13, a straight line connecting the first pivot position P1 and the central position P0 of the winding-and-tightening portion 6 of the winding-and-tightening member 5 is denoted as a reference line B. It is desirable that the second pivot position P2 is arranged within a range of ±45° centering the central position P0 of the winding-and-tightening portion 6 with respect to the reference line B. By setting as mentioned above, when a load SK is applied to the second arm 10 in the forward rotation direction S, the frictional force SM in the forward rotation direction S further assuredly acts on the winding-and-tightening member 5 in the loosening direction U, thereby further assuredly allowing the rotation of the second arm 10 in the forward rotation direction S. Furthermore, when a load GK is applied to the second arm 10 in the reverse rotation direction G, the frictional force GM in the reverse rotation direction G further assuredly acts on the winding-and-tightening member 5 in the winding-and-tightening direction V, thereby further assuredly preventing the rotation of the second arm 10 in the reverse rotation direction G. An especially desirable range is ±30°. In FIG. 7B, the upstream side of the reverse rotation direction G of the rotation shaft portion 13 of the second arm 10 with respect to the reference line B is shown as "−" and the downstream side in the reverse rotation direction G is shown as "+."

Particularly, it is desirable that the second pivot position P2 is arranged within a range from 0° to +45° to the downstream side in the reverse rotation direction G of the rotation shaft portion 13 of the second arm 10 centering the central position P0 of the winding-and-tightening portion 6 with respect to the reference line B. By arranging the second pivot position P2 on the downstream side in the reverse rotation direction G as mentioned above, when a load GK is applied to the second arm 10 in the reverse rotation direction G, the frictional force GM in the reverse rotation direction G further assuredly acts on the winding-and-tightening member 5 in the winding-and-tightening direction V, thereby further assuredly preventing the rotation of the second arm 10 in the reverse rotation direction G. In this first embodiment, the second pivot position P2 is arranged within such a range. Specifically, the second pivot position P2 is arranged within a range of +0.5° to +5° to the downstream side in the reverse rotation direction G with respect to the reference line B.

Further, as shown in FIG. 7A, the inner peripheral surface 6*c* of the winding-and-tightening portion 6 of the winding-and-tightening member 5 is in contact with the outer peripheral surface 13*a* of the rotation shaft portion 13 in a region of 180° (degrees) or more centering the axis position Q of the rotation shaft portion 13. That is, in a state in which the inner peripheral surface 6*c* of the winding-and-tightening portion 6 is in contact with the outer peripheral surface 13*a* of the rotation shaft portion 13, when the contact region centering the axis position Q of the rotation shaft portion 13 is denoted by $\alpha$, $\alpha$ is set to 180° or more (that is, $\alpha \geq 180°$). By setting as mentioned above, the rotation shaft portion 13 can be assuredly prevented from coming off from the winding-and-tightening portion 6. The upper limit of $\alpha$ is not limited, but it is especially preferred that it is smaller than 360° (that is, $\alpha < 360°$). A further desirable upper limit of $\alpha$ is 355° (that is, $\alpha \leq 355°$). In this first embodiment, $\alpha$ is set within a range of 270° to 355°, and therefore, the number of times of winding the winding-and-tightening portion 6 of the winding-and-tightening member 5 on the outer peripheral surface 13*a* of the rotation shaft portion 13 is less than 1.

In the present invention, it is not intended to exclude a case in which the winding-and-tightening portion 6 of the winding-and-tightening member 5 is wound once or more times (e.g., 1.5 to 20 windings) on the outer peripheral surface 13*a* in a spiraling manner. However, like the first embodiment, it is especially preferable that the number of winding of the winding-and-tightening portion 6 of the winding-and-tightening member 5 on the outer peripheral surface 13*a* of the rotation shaft portion is smaller than 1 winding. By setting it, as compared to a case in which the winding number is more than 1, the thickness dimension of the winding-and-tightening portion 6 of the winding-and-tightening member 5 can be reduced, which in turn can assuredly attain the reduction in size (reduction in thickness) of the angle adjuster 71.

Furthermore, the inner peripheral surface 6*c* of the winding-and-tightening portion 6 of the winding-and-tightening member 5 is formed into a shape corresponding to the outer peripheral surface 13*a* of the rotation shaft portion 13. That is, it is formed into a circular arc surface corresponding to the outer peripheral surface 13*a* of the rotation shaft portion 13. Therefore, the inner peripheral surface 6*c* of the winding-and-tightening portion 6 is continuously in surface contact with the outer peripheral surface 13*a* of the rotation shaft portion 13 in the circumferential direction. With this, the contact area between the inner peripheral surface 6*c* of the winding-and-tightening portion 6 and the outer peripheral surface 13*a* of the rotation shaft portion 13 is increased. Therefore, a frictional force GM in the reverse rotation direction G needed to prevent the rotation of the second arm 10 in the reverse rotation direction G can be obtained without increasing the diameter of the rotation shaft portion 13, which in turn can assuredly reduce the size of the angle adjuster 71.

Thus, in the angle adjuster 71 of this first embodiment, as described above, the frictional force GM in the reverse rotation direction G acts on the winding-and-tightening member 5 in the winding-and-tightening direction V, thereby elastically deforming the winding-and-tightening member 5 in the winding-and-tightening direction V. At this time, if the winding-and-tightening member 5 deforms in the winding-and-tightening direction V exceeding its elastic deformation range, the winding-and-tightening member 5 plastically deforms. As a result, the winding-and-tightening member 5 will not be returned to the initial state, preventing the normal movement of the winding-and-tightening member 5. Under the circumstances, to prevent occurrence of such problem, the angle adjuster 71 is equipped with a control means 18 to control the amount of deformation of the winding-and-tightening member 5 in the winding-and-tightening direction V. In this first embodiment, the control means 18 is a control device. The structure of the control means 18 will be explained below.

As shown in FIGS. 8 to 11, the control means 18 (control device) is equipped with a rod-shaped control member 19 and a control hole 20 formed in the tip end portion of the rotation shaft portion 13 in a manner extending in the axial direction. The control member 19 is constituted by a rivet circular in cross-section. The control hole 20 penetrates the central portion of the tip end portion of the rotation shaft portion 13 in the axial direction. The cross-sectional shape of the control hole 20 is circular. The diameter of the control hole 20 is set to be larger than the diameter of the control member 19.

Each outer plate portion 3 of the first arm 1 is provided with an insertion hole 3*c* for the control member 19. Also, the control member 19 is inserted into the insertion holes 3*c* and 3*c* of both the outer plate portions 3 and 3 and the control hole 20, and the tip end portion of the control member 19 is crushed into a large diameter shape. By this, both the outer plate portions 3 and 3 are connected (fastened) to each other via the control member 19. As shown in FIG. 6, in a state in which a load SK in the forward rotation direction S and a load GK in the reverse rotation direction G are not applied to the second arm 10, the control member 19 is arranged coaxially with the center of the control hole 20 in the control hole 20. Therefore, an annular shaped gap is formed between the control member 19 and the inner peripheral surface of the control hole 20 along the entire circumference of the control member 19. The central position of the control hole 20 coincides with the axis position Q of the rotation shaft portion 13.

In this control means 18, when the amount of deformation of the winding-and-tightening member 5 in the winding-and-tightening direction V due to the frictional force GM in the reverse rotation direction G reaches a predetermined amount, the inner peripheral surface of the control hole 20 comes into contact with the control member 19 (see FIG. 14D), controlling the amount of deformation of the winding-and-tightening member 5 in the winding-and-tightening direction V, which in turn prevents the plastic deformation of the winding-and-tightening member 5 in the winding-and-tightening direction V.

Further, in this angle adjuster 71, as described above, the frictional force SM in the forward rotation direction S acts on the winding-and-tightening member 5 in the loosening direction U, thereby elastically deforming the winding-and-tightening member 5 in the loosening direction V. If the winding-and-tightening member 5 deforms in the loosening direction U exceeding its elastic deformation range, the winding-and-tightening member 5 plastically deforms. As a result, the winding-and-tightening member 5 will not be returned to the initial state, which prevents a normal movement of the winding-and-tightening member 5. Therefore, to prevent occurrence of such problem, the control means 18 is configured such that, when an amount of deformation of the winding-and-tightening member 5 in the loosening direction U caused by a frictional force SM in the forward rotation direction S reaches a predetermined amount, the inner peripheral surface of the control hole 20 comes into contact with the control member 19 to thereby control the amount of deformation of the winding-and-tightening member 5 in the loosening direction U. By the control of the amount of deformation as mentioned above, the plastic deformation of the winding-and-tightening member 5 in the loosening direction U is prevented.

Figure 14A:
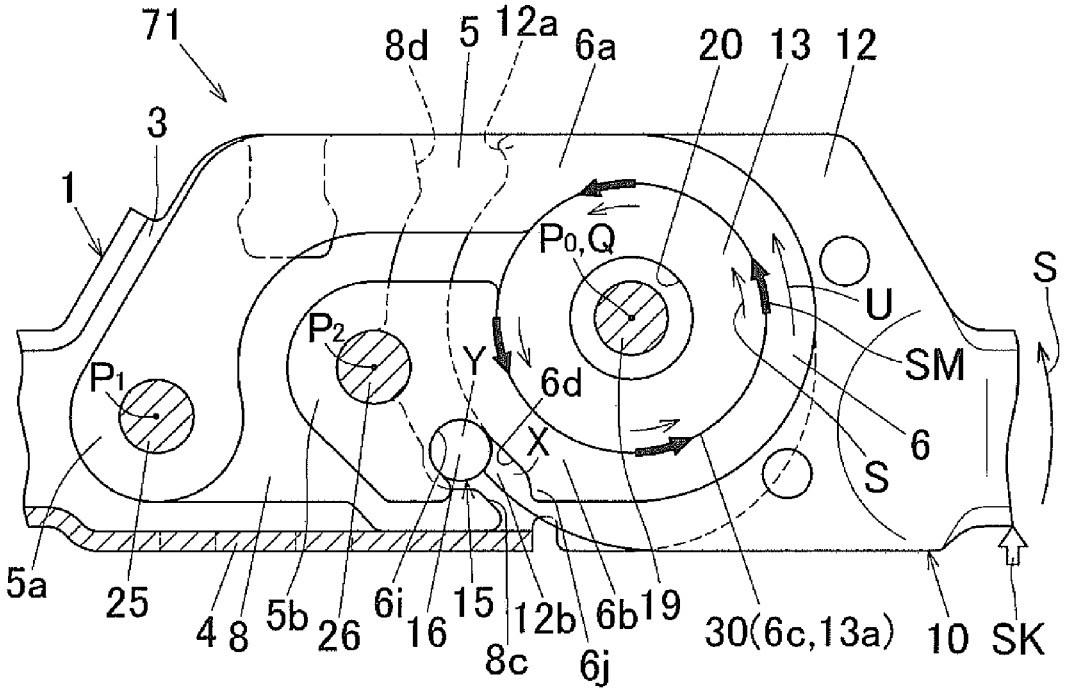
FIG. 14A is an enlarged cross-sectional view showing a case in which the development angle of the second arm of the angle adjuster is about 180° and a load in the forward rotation direction is applied to the second arm.
Figure 14B:
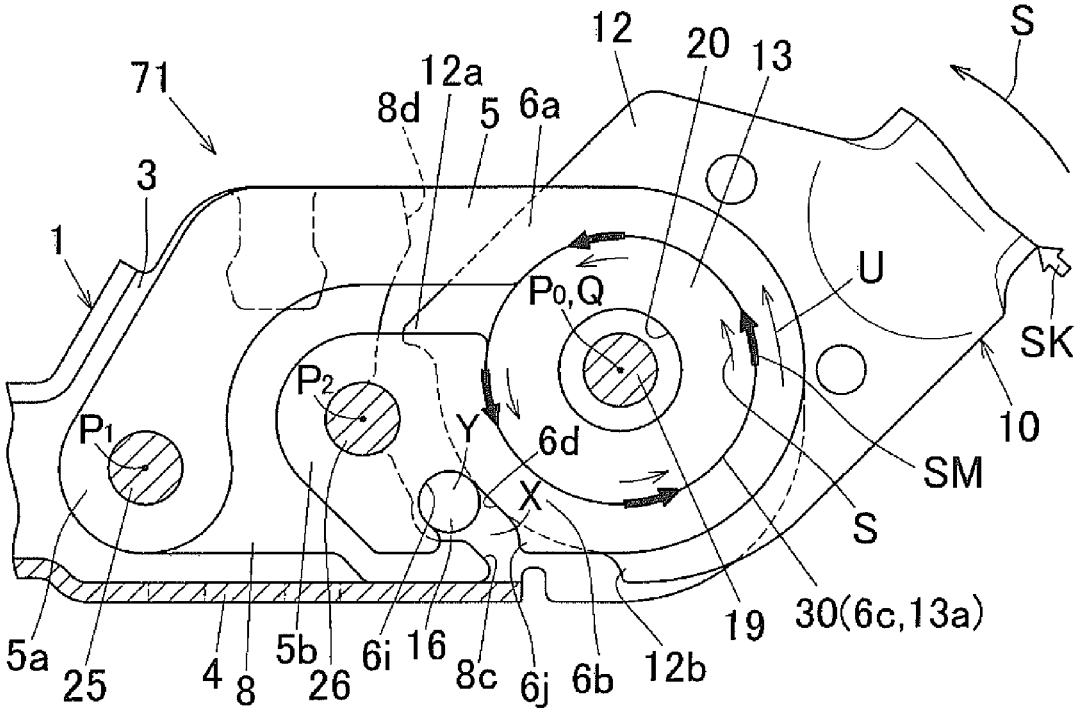
FIG. 14B is an enlarged cross-sectional view showing a case in which the development angle of the second arm of the angle adjuster is about 135° and a load in the forward rotation direction is applied to the second arm.
Figure 14C:
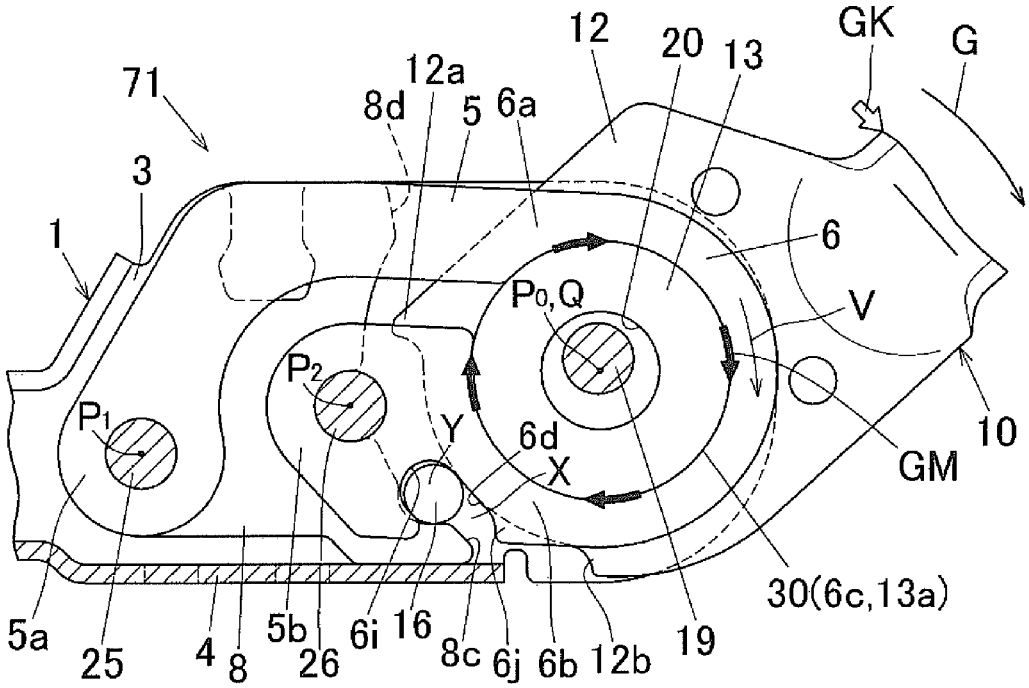
FIG. 14C is an enlarged cross-sectional view showing a case in which the development angle of the second arm of the angle adjuster is about 135° and a load in the reverse rotation direction is applied to the second arm.
Figure 14D:
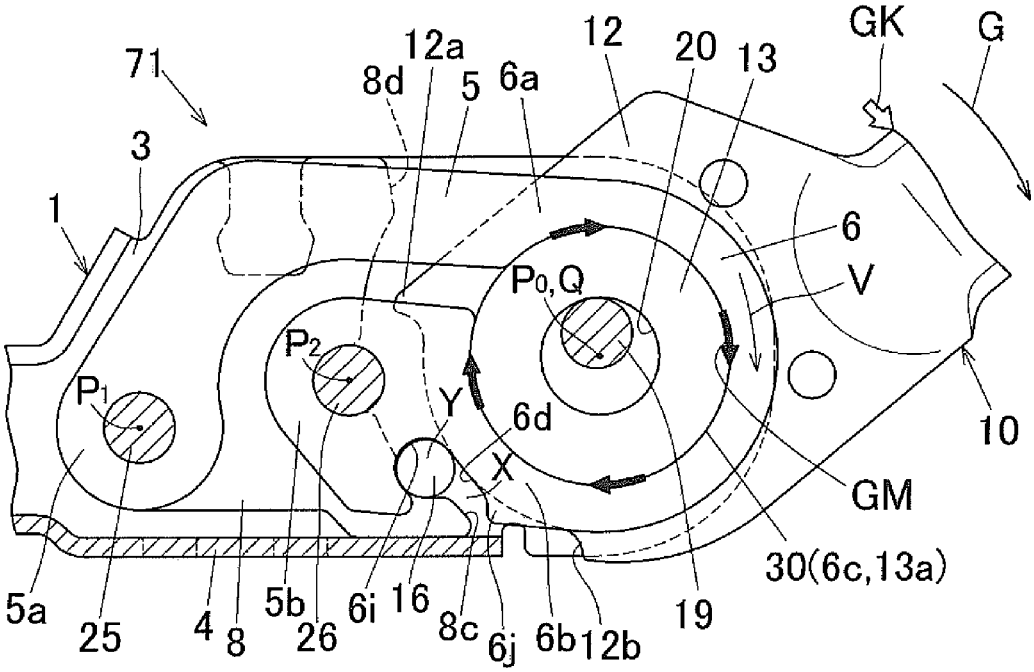
FIG. 14D is an enlarged cross-sectional view showing a state in which the amount of deformation of the winding-and-tightening member in the winding-and-tightening direction is controlled by the control means.
Figure 14E:
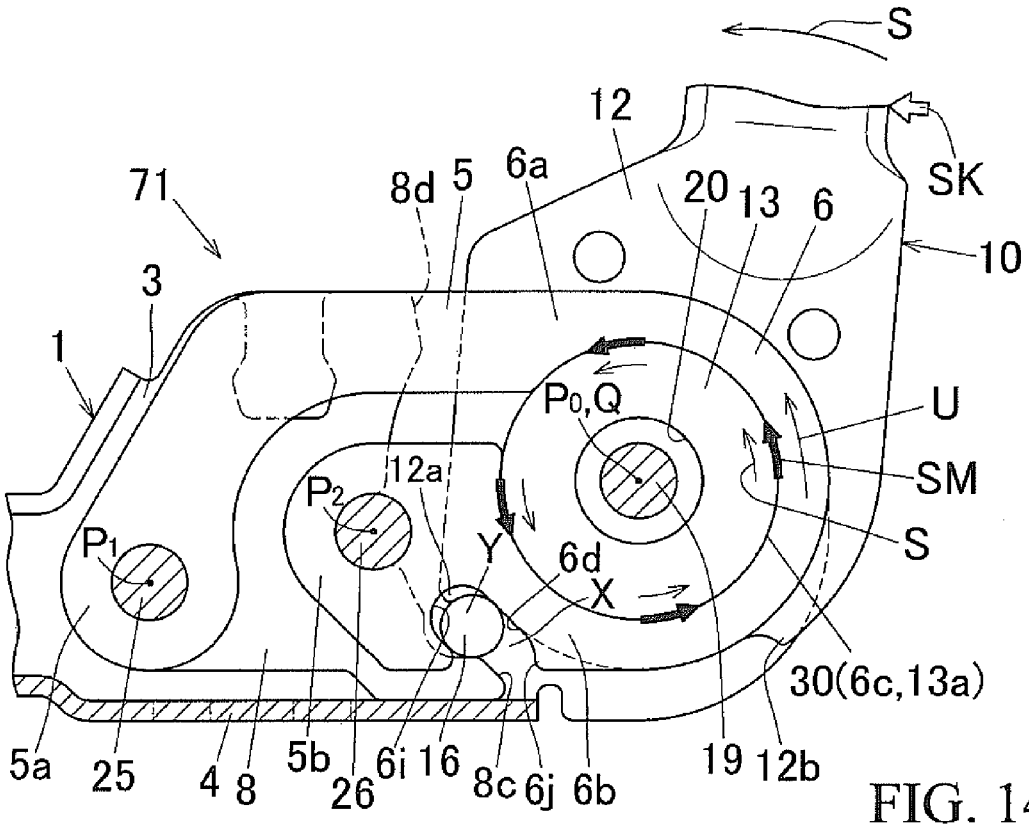
FIG. 14E is an enlarged cross-sectional view showing a half-way state in which the pressing member is pushed from the non-pressing position to the pressing position with the first pushing portion of the rotation plate portion of the second arm.
Figure 14F:
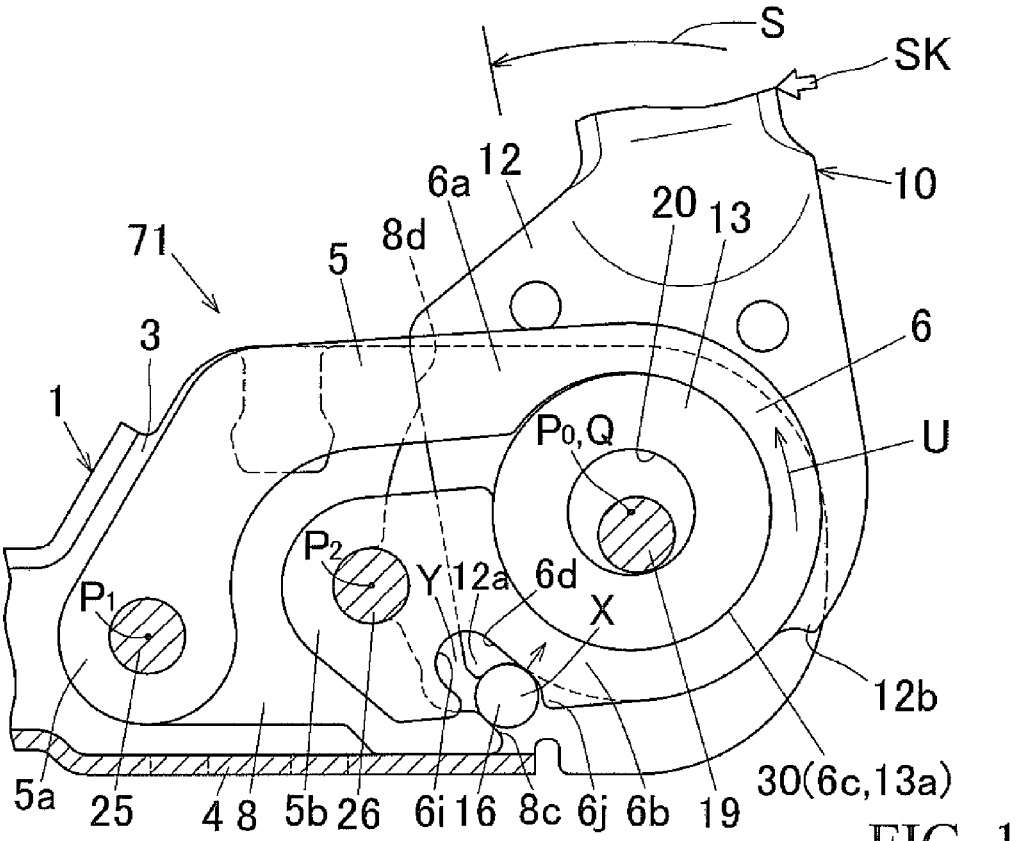
FIG. 14F is an enlarged cross-sectional view showing a state in which the pressing member is pushed to the pressing position with the first pushing portion of the rotation plate portion of the second arm to thereby release the prevention of rotation of the second arm in the reverse rotation direction.

Furthermore, in this angle adjuster 71, the upper edge portion of the spacer member 8 of the first arm 1 on the rotation shaft portion 13 side, as shown in FIG. 14F, comes into contact with the second arm 10 maximally rotated in the forward rotation direction S, and therefore constitutes a stopper portion 8*d* for stopping the rotation of the second arm 10 in the forward rotation direction S.

Furthermore, the angle adjuster 71 is equipped with a release means 15 for releasing the prevention of rotation of the second arm 10 in the reverse rotation direction G when the second arm 10 is maximally rotated in the forward rotation direction S. In this first embodiment, this release means 15 is a release device (releaser.) The structure of the release means 15 will be explained below.

As shown in FIGS. 8 to 11, the release means 15 (release device) is equipped with a pressing member 16 having rigidity and the rotation plate portion 12. The pressing member 16 is made of metal such as steel, and is a pin-shaped member extending in the thickness direction T of the angle adjuster 71. The cross-sectional shape of the pressing member 16 is circular.

The pressing member 16 simultaneously presses both the winding-and-tightening portions 6 and 6 of both the winding-and-tightening members 5 and 5 in the loosening direction U so as to decrease the winding-and-tightening forces of both the winding-and-tightening members 5 and 5 to cause elastic deformation of both winding-and-tightening portions 6 and 6 to thereby release the prevention of rotation of the second arm 10 in the reverse rotation direction G (see FIGS. 14A and 14F.) Furthermore, the pressing member 16, as shown in FIGS. 6 and 7A, is arranged movably between a pressing position X where both the winding-and-tightening members 5 and 5 (specifically, the winding-and-tightening portions 6 and 6 of both the winding-and-tightening members 5 and 5) are pressed and deformed in the loosening direction U and a non-pressing position Y where both the winding-and-tightening members 5 and 5 (specifically, winding-and-tightening portions 6 and 6 of both the winding-and-tightening members 5 and 5) are not pressed and deformed. In this first embodiment, the pressing member 16 is arranged so as to be movable between the pressing position X and the non-pressing position Y on the outside of both the outer peripheral surfaces 6*d* and 6*d* of both the other end portion side sections 6*b* and 6*b* of both the winding-and-tightening portions 6 and 6 of both the winding-and-tightening members 5 and 5 in a manner as to bridge both the outer peripheral surfaces 6*d* and 6*d* of both end portion side sections 6*b* and 6*b*. Here, the other end portion side section 6*b* of the winding-and-tightening portion 6 of the winding-and-tightening member 5 denotes the same as the second pivot position P2 side section of the winding-and-tightening portion 6 of the winding-and-tightening member 5.

At the portion corresponding to the non-pressing position Y of each of both the outer peripheral surfaces 6*d* and 6*d* of both the other end portion side sections 6*b* and 6*b*, a concave portion 6*i* for maintaining the pressing member 16 in the non-pressing position Y is formed. The cross-sectional shape of the concave portions 6*i* is a circularly concaved shape corresponding to the cross-sectional shape of the pressing member 16. Further, the opening edge of the concave portion 6*i* is formed so as to extend toward the pressing position X side and therefore, the concave portion 6*i* also functions as a guiding portion when the pressing member 16 moves from the non-pressing position Y to the pressing position X. Also, at the vicinity of the portion of each of both the outer peripheral surfaces 6*d* and 6*d* of both the other end portion side sections 6*b* and 6*b*, a protruded portion 6*j* for stopping the pressing member 16 at the pressing position X moving from the non-pressing position Y toward the pressing position X is formed.

The bottom edge portion of the spacer member 8 of the first arm 1 on the rotation shaft portion 13 side is formed so as to protrude toward the rotation shaft portion 13 and is in contact with the bottom plate portion 4 of the first arm 1 so as to not deform downwardly. The tip end portion of the bottom edge portion constitutes a pressing portion 8*c* for pressing the pressing member 16 arranged at the pressing position X against both the outer peripheral surfaces 6*d* and 6*d* of both the other end portion side sections 6*b* and 6*b* of both the winding-and-tightening portions 6 and 6 of both the winding-and-tightening member 5 and 5. As shown in FIG. 7A, the pressing portion 8*c* is arranged at a position corresponding to the pressing position X so that the space W between the pressing portion 8*c* and the outer peripheral surface 6*d* of the other end portion side section 6*b* is smaller than the thickness size D (that is, the diameter) of the pressing member 16 (that is, W<D.) With this, when the pressing member 16 is pressed forcibly from the non-pressing position Y in between the pressing portion 8*c* and the outer peripheral surface 6*d* of the other end portion side section 6*b*, the pressing member 16 is pressed to the outer peripheral surface 6*d* of the other end portion side section 6*b* by the pressing portion 8*c*. This causes deformation of the winding-and-tightening member 5 (specifically, the winding-and-tightening portion 6*b* of the winding-and-tightening member 5) in the loosening direction U against the spring elastic force of the winding-and-tightening member 5.

At predetermined separated positions of the rotation plate portion 12 of the second arm 10 on the outer peripheral edge portion of the rotation plate portion 12 on the second pivot position P2 side, a first pushing portion 12*a* and a second pushing portion 12*b* are integrally formed in a radially outwardly protruded manner. The first pushing portion 12*a* is a portion for pushing the pressing member 16 arranged at the non-pressing position Y to the pressing position X when the second arm 10 is maximally rotated in the forward rotation direction S. The second pushing portion 12*b* is a portion for pushing the pressing member 16 arranged at the pressing position X to the non-pressing position Y (that is, push back to the non-pressing position Y) when the second arm 10 is maximally rotated in the reverse rotation direction G. Furthermore, the portion of the outer peripheral edge portion of the rotation plate portion 12 between the first pushing portion 12*a* and the second pushing portion 12*b* is formed into a circular arc shape along the outer peripheral surface 6*d* of the other end portion side section 6*b* of the winding-and-tightening portion 6 of the winding-and-tightening member 5.

As explained above, the pressing member 16 is arranged so as to bridge both the outer peripheral surfaces 6*d* and 6*d* of both the other end portion side sections 6*b* and 6*b* of both the winding-and-tightening portions 6 and 6 of both the winding-and-tightening members 5 and 5, and therefore the pressing member 16 can be moved steadily between the pressing position X and the non-pressing position Y. Therefore, the position of the pressing member 16 can be smoothly switched between the pressing position X and the non-pressing position Y, and the detachment of the pressing member 16 can be prevented.

Next, the movement of the angle adjuster 71 of the first embodiment will be explained with reference to FIGS. 14A to 14H.

In the angle adjuster 71 shown in FIG. 14A, the second arm 10 is arranged at a position of the maximum development angle θ with respect to the first arm 1, that is, θ=about 180°. The pressing member 16 is held in the concave portion 6*i*, and therefore arranged at the non-pressing position Y. Furthermore, the outer peripheral surface 13*a* of the rotation shaft portion 13 of the second arm 10 is wound and tightened consistently by the winding-and-tightening member 5 due to the spring elastic force of the winding-and-tightening member 5. In this state, when a load SK is applied to the second arm 10 in the forward rotation direction S, the second arm 10 is urged to rotate in the forward rotation direction S centering the rotation shaft portion 13. In accordance with such a rotational movement in the forward rotation direction S, a frictional force SM in the forward rotation direction S is generated on the contact portion 30 between the outer peripheral surface 13*a* of the rotation shaft portion 13 and the inner peripheral surface 6*c* of the winding-and-tightening portion 6 of the winding-and-tightening member 5. This frictional force SM acts on the winding-and-tightening member 5 (specifically, the winding-and-tightening portion 6 of the winding-and-tightening member 5) in the loosening direction U with respect to the outer peripheral surface 13*a* of the rotation shaft portion 13. Due to this frictional force SM, the winding-and-tightening member 5 slightly deforms elastically in the loosening direction U with the first pivot position P1 and the second pivot position P2 as the fixed ends (specifically, rotation ends) so that the inner diameter of the winding-and-tightening portion 6 increases. Therefore, the winding-and-tightening force of the winding-and-tightening member 5 to the outer peripheral surface 13*a* of the rotation shaft portion 13 decreases, thereby allowing the rotation of the second arm 10 in the forward rotation direction S. Therefore, when a load SK is applied to the second arm 10 in the forward rotation direction S, the second arm 10 rotates in the forward rotation direction S.

In the angle adjuster 71 shown in FIG. 14B, the second arm 10 is arranged at a position in which the development angle θ with respect to the first arm 1 is about 135°. In this state, when a load SK is applied to the second arm 10 in the forward rotation direction S, the second arm 10 rotates in the forward rotation direction S in the same manner as in the case of FIG. 14A.

On the other hand, in the state shown in FIG. 14B, when a load GK is applied to the second arm 10 in the reverse rotation direction G, as shown in FIG. 14C, the second arm 10 is urged to rotate in the reverse rotation direction G centering the rotation shaft portion 13 of the second arm 10. By such a rotational movement in the reverse rotation direction G, a frictional force GM in the reverse rotation direction G is generated on the contact portion 30 between the outer peripheral surface 13*a* of the rotation shaft portion 13 and the inner peripheral surface 6*c* of the winding-and-tightening portion 6 of the winding-and-tightening member 5, and the frictional force GM acts on the winding-and-tightening member 5 (specifically, the winding-and-tightening portion 6 of the winding-and-tightening member 5) in the winding-and-tightening direction V with respect to the outer peripheral surface 13*a* of the rotation shaft portion 13. Due to this frictional force GM, the winding-and-tightening member 5 slightly deforms elastically in the winding-and-tightening direction V with the first pivot position P1 and the second pivot position P2 as the fixed ends (specifically, rotation ends) so that the inner diameter of the winding-and-tightening portion 6 decreases. Therefore, the winding-and-tightening force of the winding-and-tightening member 5 to the outer peripheral surface 13*a* of the rotation shaft portion 13 increases. As a result, the rotation of the second arm 10 in the reverse rotation direction G is prevented. Therefore, when a load GK is applied to the second arm 10 in the reverse rotation direction G, the second arm 10 will not rotate in the reverse rotation direction G.

Furthermore, when a large load GK is applied to the second arm 10 in the reverse rotation direction G, as shown in FIG. 14D, the amount of deformation of the winding-and-tightening member 5 in the winding-and-tightening direction V increases, which brings the inner peripheral surface of the control hole 20 into contact with the control member 19. In this way, the amount of deformation of the winding-and-tightening member 5 in the winding-and-tightening direction V is controlled. If, in this state, an extremely large load GK is applied to the second arm 10 in the reverse rotation direction G, the outer peripheral surface 13*a* of the rotation shaft portion 13 slips and rotates with respect to the inner peripheral surface 6*c* of the winding-and-tightening portion 6 of the winding-and-tightening member 5 in the reverse rotation direction G. For this reason, an excessive load will not be applied to the winding-and-tightening member 5. In this way, the winding-and-tightening member 5 will not plastically deform in the winding-and-tightening direction V, and breakage of the winding-and-tightening member 5 due to the application of an excessive load to the winding-and-tightening member 5 can be prevented. Also, even when the outer peripheral surface 13*a* of the rotation shaft portion 13 slips and rotates, since the winding-and-tightening member 5 is not plastically deformed, when stopping the application of an extremely large load GK to the second arm 10 in the reverse rotation direction G, the winding-and-tightening member 5 will be returned to its initial state by its own spring elastic force and thereby operate normally.

Figure 14G:
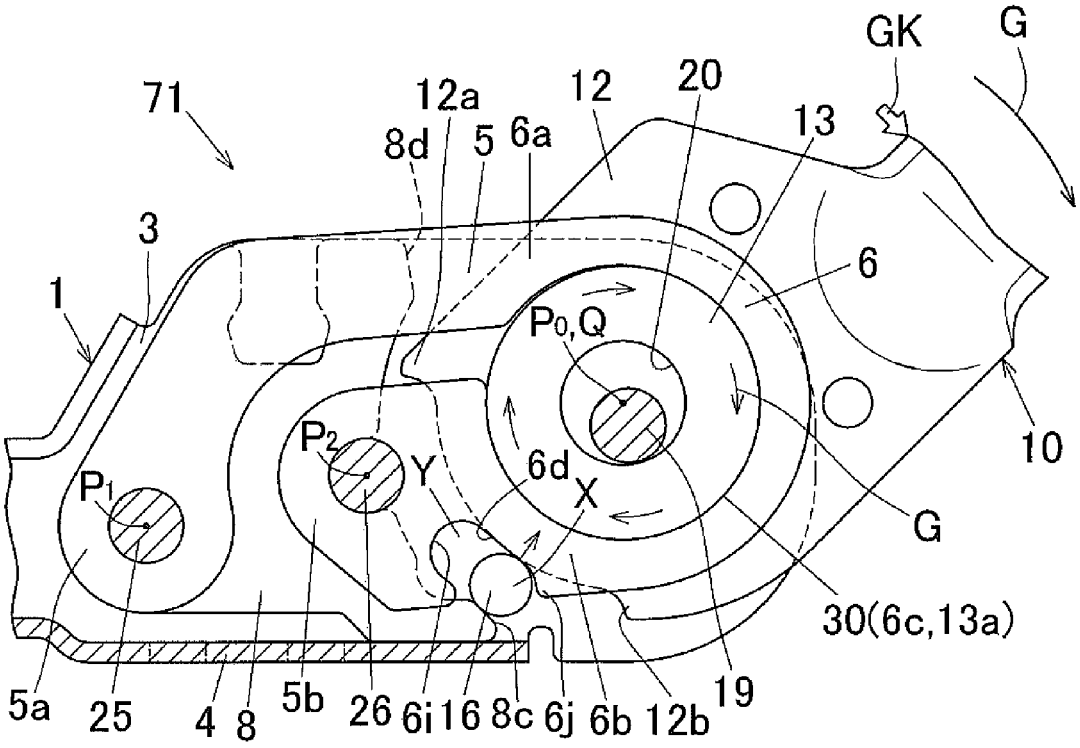
FIG. 14G is an enlarged cross-sectional view showing a state in which the second arm is rotated in the reverse rotation direction.

In the angle adjuster 71 shown in FIG. 14B, when the second arm 10 is greatly rotated in the forward rotation direction S, as shown in FIG. 14E, the first pushing portion 12*a* of the rotation plate portion 12 of the second arm 10 comes into contact with the pressing member 16 immediately before the second arm 10 maximally rotates in the forward rotation direction S. Then, when the second arm 10 maximally rotates in the forward rotation direction S, as shown in FIG. 14F, the second arm 10 comes into contact with the stopper portion 8*d* of the spacer member 8 of the first arm 1, thereby stopping the further rotation of the second arm 10 in the forward rotation direction S and pushing the pressing member 16 to the pressing position X by the first pushing portion 12*a*. At this time, the pressing member 16 is forcefully pressed in between the pressing portion 8*c* and the outer peripheral surface 6*d* of the other end portion side section 6*b* of the winding-and-tightening portion 6 of the winding-and-tightening member 5. In this way, the pressing member 16 is pressed against the outer peripheral surface 6*d* of the other end portion side section 6*b* at the pressing portion 8*c*, thereby simultaneously pressing the winding-and-tightening member 5 (specifically, the winding-and-tightening portion 6 of the winding-and-tightening member 5) in the loosening direction U, which in turn elastically deforms the winding-and-tightening member 5 in the loosening direction U against the spring elastic force of the winding-and-tightening member 5. As a result, the prevention of rotation of the second arm 10 in the reverse rotation direction G is released. Furthermore, the pressing member 16 is held at the pressing position X by being forcefully pressed in between the pressing portion 8*c* and the outer peripheral surface 6*d* of the other end portion side section 6*b*. As a result, the second arm 10 is maintained in a state in which the prevention of the rotation in the reverse rotation direction G is released. Therefore, when a load GK is applied to the second arm 10 in the reverse rotation direction G in this state, as shown in FIG. 14G, the second arm 10 rotates in the reverse rotation direction G. Also, as shown in FIG. 14F, when the winding-and-tightening member 5 is deformed in the loosening direction U by the pressing member 16, the inner peripheral surface of the control hole 20 comes into contact with the control member 19, thereby controlling the amount of deformation of the winding-and-tightening member 5 in the loosening direction U.

Figure 14H:
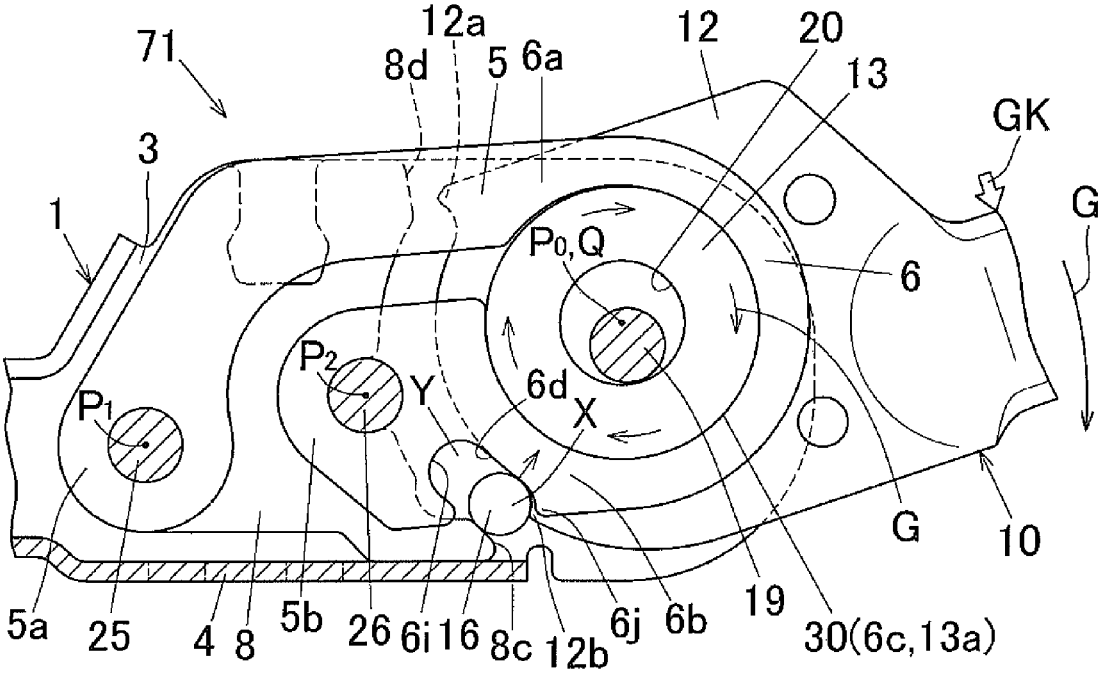
FIG. 14H is an enlarged cross-sectional view showing a half-way state in which the pressing member is pushed from the pressing position to the non-pressing position with the second pushing portion of the rotation plate portion of the second arm.

In the angle adjuster 71 shown in FIG. 14G, when the second arm 10 is greatly rotated in the reverse rotation direction G, as shown in FIG. 14H, the second pushing portion 12*b* of the rotation plate portion 12 of the second arm 10 comes into contact with the pressing member 16 immediately before the second arm 10 maximally rotates in the reverse rotation direction G. Then, when the second arm 10 is maximally rotated in the reverse rotation direction G, the pressing member 16 is pushed by the second pushing portion 12*b* from the pressing position X to the non-pressing position Y (that is, pushed back to the non-pressing position Y). In this way, the second arm 10 is returned to the original state.

According to the angle adjuster 71 of the first embodiment, since the rotation of the second arm 10 is prevented or allowed by increasing and decreasing the winding-and-tightening force of the winding-and-tightening member 5, the development angle θ of the second arm 10 with respect to the first arm 1 can be adjusted in a non-stepwise manner. Furthermore, no sound is produced at the time of rotating the second arm 10 in the forward rotation direction S, and therefore the adjustment of the development angle θ of the second arm 10 can be performed quietly.

Furthermore, the winding-and-tightening force of the winding-and-tightening member 5 acts on the outer peripheral surface 13*a* of the rotation shaft portion 13, eliminating the use of the fixed boss portion of the first arm of the angle adjuster as disclosed in the abovementioned Japanese Unexamined Patent Application Publication No. 2009-45395, which in turn enables reduction of the size (thinning) of the angle adjuster.

Furthermore, since one end portion 5*a* and the other end portion 5*b* of the winding-and-tightening member 5 are provided at the first arm 1, it is not required to fix one end portion 5*a* of the winding-and-tightening member 5 to the rotation shaft portion 13. Therefore, the assembling operation of the angle adjuster 71 can be performed easily.

Furthermore, the winding-and-tightening member 5 has spring elasticity in the winding-and-tightening direction V and the loosening direction U, which assuredly enables returning of the winding-and-tightening member 5 deformed in the winding-and-tightening direction V or the loosening direction U to the initial position (initial state.)

Furthermore, since the outer peripheral surface 13*a* of the rotation shaft portion 13 is wound and tightened consistently by the spring elastic force of the winding-and-tightening member 5, unexpected rotation of the second arm 10 in the forward rotation direction S can be prevented. Furthermore, when a load GK in the reverse rotation direction G is applied to the second arm 10, the frictional force GM in the reverse rotation direction G can be assuredly applied to the winding-and-tightening member 5, thereby making it possible to assuredly prevent the rotation of the second arm 10 in the reverse rotation direction G.

Furthermore, since one end portion 5*a* and the other end portion 5*b* of the winding-and-tightening member 5 are pivotally fixed to the first arm 1, in accordance with the deforming movement of the winding-and-tightening member 5 in the winding-and-tightening direction V or the loosening direction U, one end portion 5*a* and the other end portion 5*b* of the winding-and-tightening member 5 rotate respectively centering the first rivet 25 and the second rivet 26. Therefore, the winding-and-tightening member 5 assuredly deforms in the winding-and-tightening direction V and the loosening direction U, which in turn can assuredly prevent or allow the rotation of the second arm 10.

Furthermore, since the angle adjuster 71 includes the control means 18 for controlling an amount of deformation of the winding-and-tightening member 5 in the winding-and-tightening direction V, the plastic deformation of the winding-and-tightening member 5 due to the deformation of the winding-and-tightening member 5 exceeding the elastic deformation range of the winding-and-tightening member 5 in the winding-and-tightening direction V can be prevented. With this, it becomes possible to assuredly return the winding-and-tightening member 5 to the initial state.

Furthermore, since both the winding-and-tightening members 5 and 5 and the rotation shaft portion 13 are arranged between both the outer plate portions 3 and 3 of the first arm 1, the winding-and-tightening member 5 and 5 and the rotation shaft portion 13 are protected by both the outer plate portions 3 and 3 so that both the winding-and-tightening members 5 and 5 and the rotation shaft portion 13 operate normally. Furthermore, since both the outer plate portions 3 and 3 are connected to each other via the control member 19 constituted by a rivet, both the outer plate portions 3 and 3 are prevented from deforming in the developing direction by the control member 19. Therefore, it is possible to assuredly protect both the winding-and-tightening members 5 and 5 and the rotation shaft portion 13 with both the outer plate portions 3 and 3.

Furthermore, since the rotation plate portion 12 is provided with the first pushing portion 12*a*, when the second arm 10 maximally rotates in the forward rotation direction S, the pressing member 16 can be arranged at the pressing position X, and therefore, the operation to release the rotation of the second arm 10 in the reverse rotation direction G can be easily performed. Furthermore, since the rotation plate portion 12 is provided with the second pushing portion 12*b*, by maximally rotating the second arm 10 in the reverse rotation direction G, the pressing member 16 can be arranged at the non-pressing position Y. Therefore, the operation to return the second arm 10 to the original state can be easily performed.

In the present invention, in the angle adjuster 71 of the abovementioned first embodiment, at least one of the outer peripheral surface 13*a* of the rotation shaft portion 13 and the inner peripheral surface 6*c* of the winding-and-tightening portion 6 of the winding-and-tightening member 5 can be subjected to a process for increasing the frictional force to be generated on the contact portion 30 of both surfaces, a process for reducing the frictional force, or a process for adjusting the amount of the frictional force to an appropriate amount.

Figure 15A:
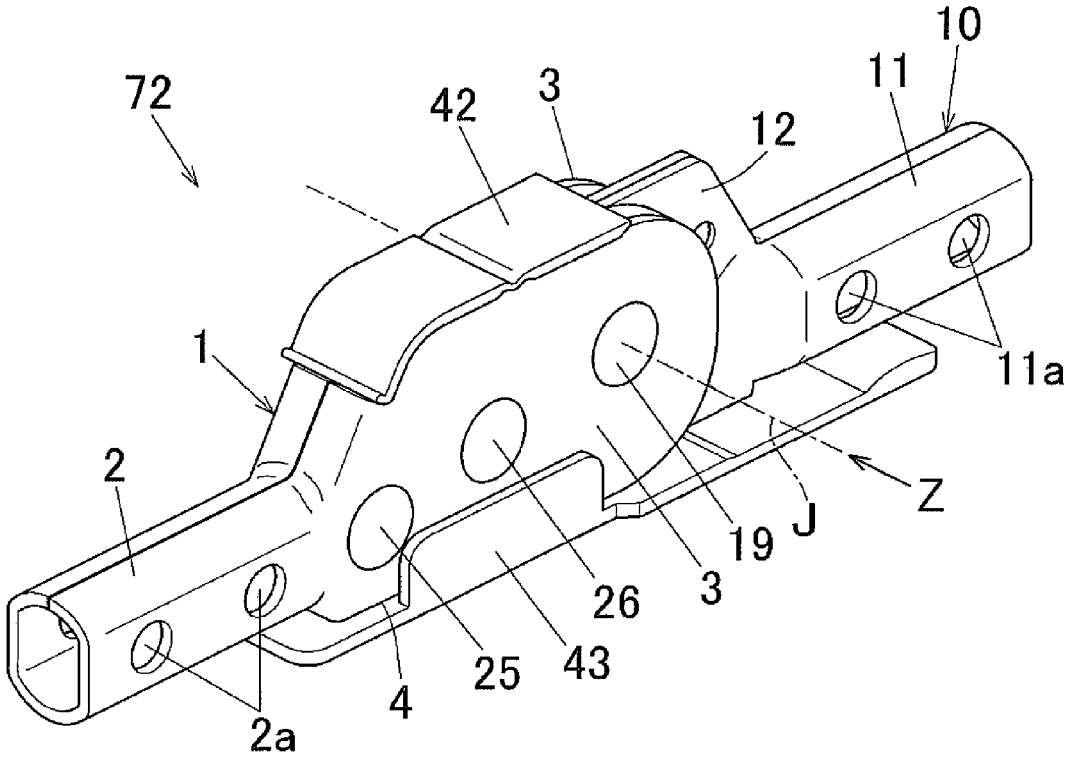
FIG. 15A is a perspective view showing an angle adjuster according to a second embodiment of the present invention.
Figure 15B:
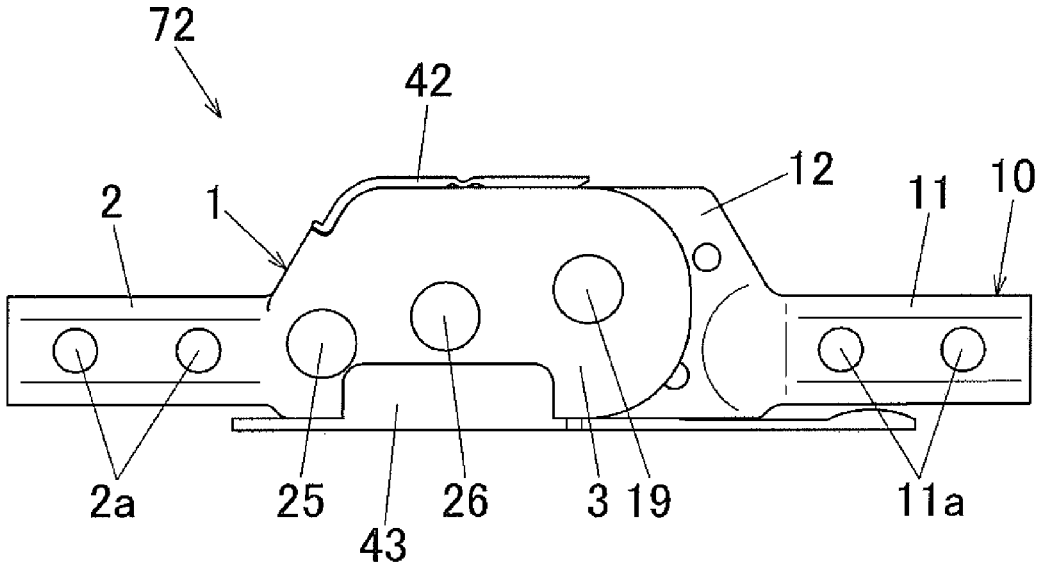
FIG. 15B is a side view showing the angle adjuster.
Figure 15C:
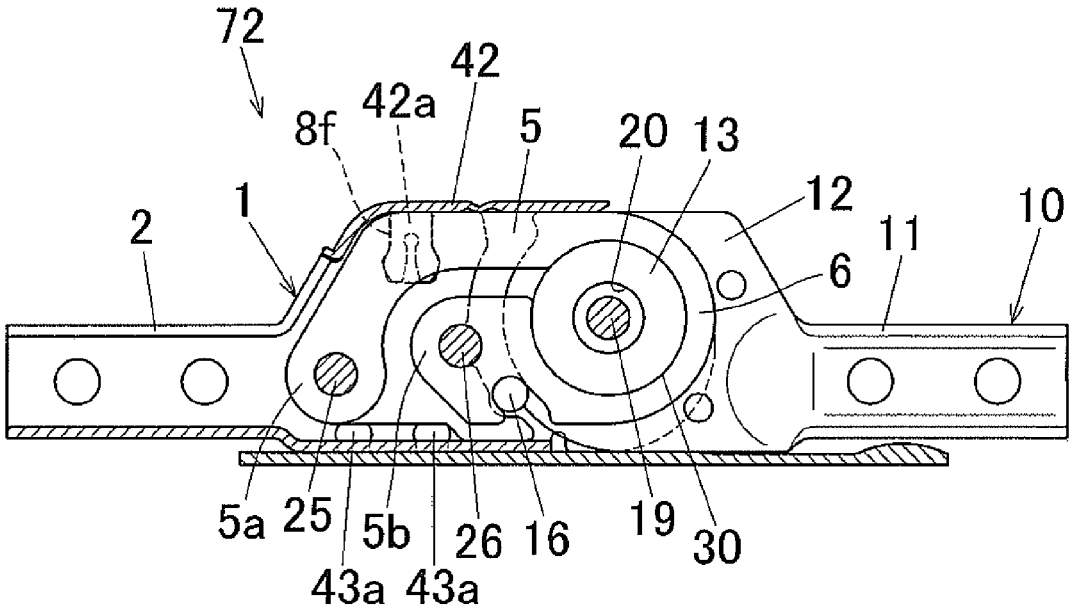
FIG. 15C is a cross-sectional view showing the angle adjuster.

FIGS. 15A to 15C are perspective views showing an angle adjuster 72 according to a second embodiment of the present invention. In these drawings, the same symbols are allotted to the constituent elements corresponding to the constituent elements of the angle adjuster 71 of the first embodiment.

The angle adjuster 72 is equipped with a plate-shaped upper cover member 42 covering both the winding-and-tightening members 5 from the upper side thereof and a plate-shaped lower cover member 43 covering both the winding-and-tightening members from the lower side thereof. The upper cover member 42 and the lower cover member 43 are both made of resin.

Figure 15D:
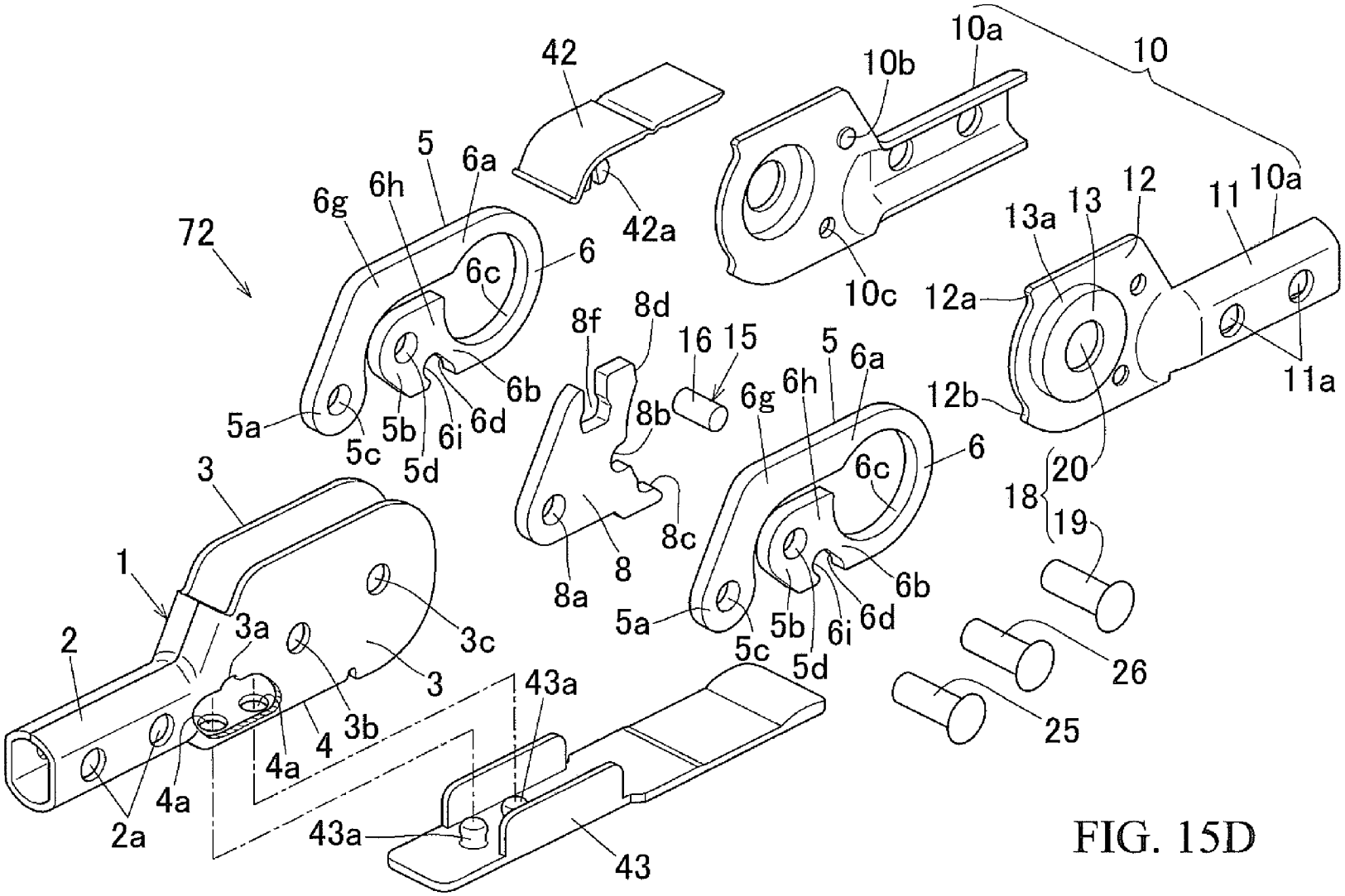
FIG. 15D is an exploded perspective view showing the angle adjuster.

As shown in FIG. 15D, an elastic engaging protruded portion 42*a* is integrally formed on the lower surface of the upper cover member 42. An engaging concave portion 8*f* corresponding to the elastic engaging protruded portion 42*a* is formed on the upper edge portion of the spacer member 8. After assembling the angle adjuster 72, the elastic engaging protruded portion 42*a* is forcefully inserted downwardly into the engaging concave portion 8*f* from the upper side thereof. With this, as shown in FIG. 15C, the elastic engaging protruded portion 42*a* is engaged with the engaging concave portion 8*f* in an engageable and detachable manner. Thus, the upper cover member 42 is attached to the angle adjuster 72 so as to cover both the winding-and-tightening members 5 and 5 from the upper side thereof. In this state, by strongly pulling the upper cover member 42 in the upward direction, the elastic engaging protruded portion 42*a* is disengaged from the engaging concave portion 8*f*, removing the upper cover member 42 from the angle adjuster 72. In this way, the upper cover member 42 is attached to the angle adjuster 72 in an engageable and detachable manner.

As shown in FIG. 15D, a plurality of elastic pressing protruded portions 43*a* are integrally formed on the upper surface of the lower cover member 43. A plurality of press-in holes 4*a* corresponding to the elastic pressing protruded portions 43*a* are punched and provided in the bottom plate portion 4 of the first arm 1. After assembling the angle adjuster 72, by forcefully pressing the elastic pressing protruded portions 43*a* into the press-in holes 4*a* upwardly from the lower side thereof, as shown in FIG. 15C, the elastic pressing protruded portions 43*a* are pressed into the press-in holes 4*a* in an engageable and detachable manner. Thus, the lower cover member 43 is attached to the angle adjuster 72 so as to cover both the winding-and-tightening members 5 and 5 (especially both the winding-and-tightening portions 6 and 6) from the lower side thereof. In this state, by strongly pulling the lower cover member 43 in the downward direction, the elastic pressing protruded portions 43*a* are pulled out from the press-in holes 4*a*, removing the lower cover member 43 from the angle adjuster 72. In this way, the lower cover member 43 is attached to the angle adjuster 72 in an engageable and detachable manner.

According to this angle adjuster 72, both the winding-and-tightening members 5 and 5 can be covered by the upper cover member 42 and the lower cover member 43 so that both the winding-and-tightening members 5 and 5 operate normally. Furthermore, since each cover member 42 and 43 is attached to the angle adjuster 72 in an engageable and detachable manner, the operation to attach each cover member 42 and 43 can be performed easily.

Figure 16A:
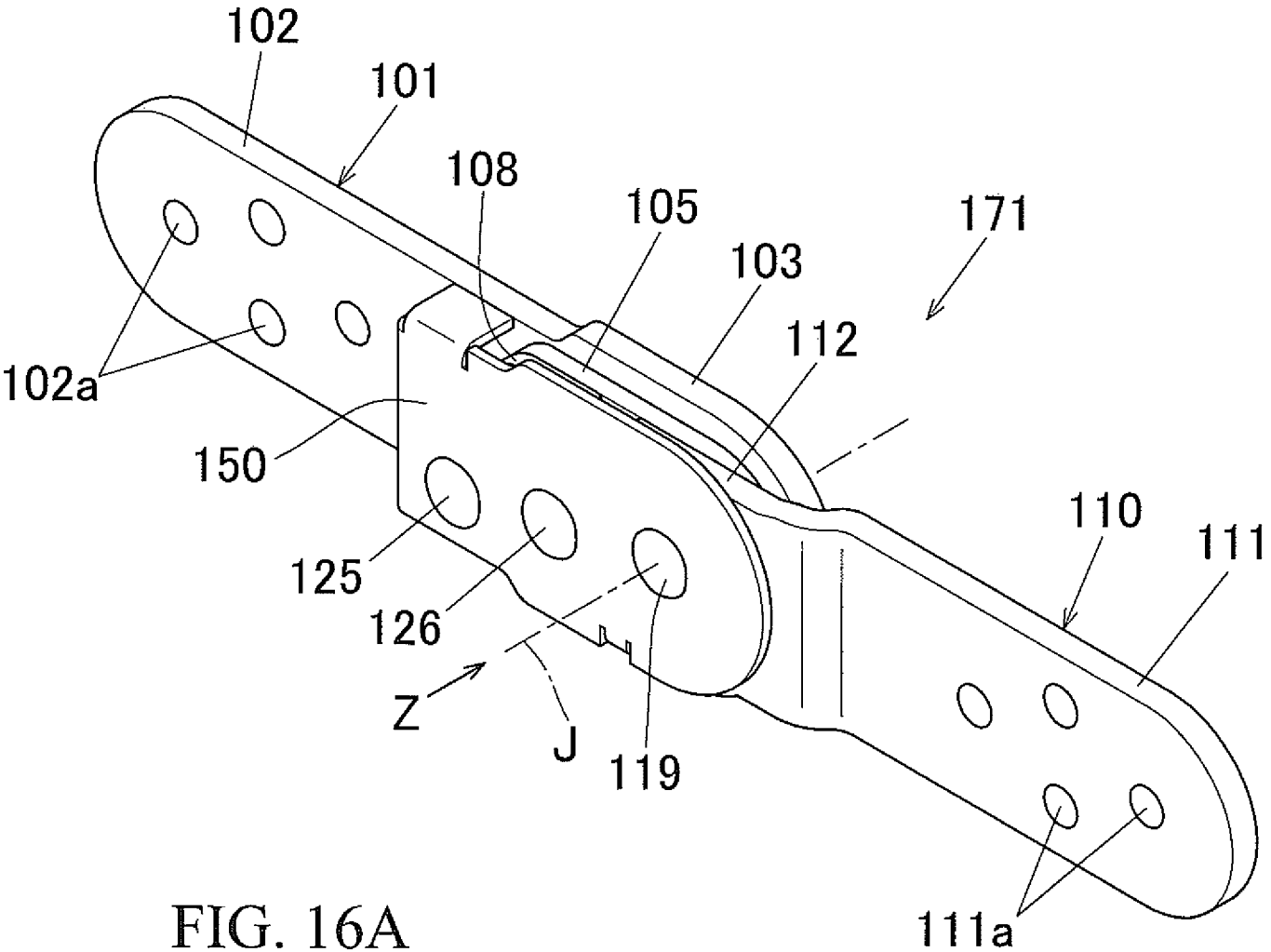
FIG. 16A is a perspective view showing an angle adjuster according to a third embodiment of the present invention.
Figure 16B:
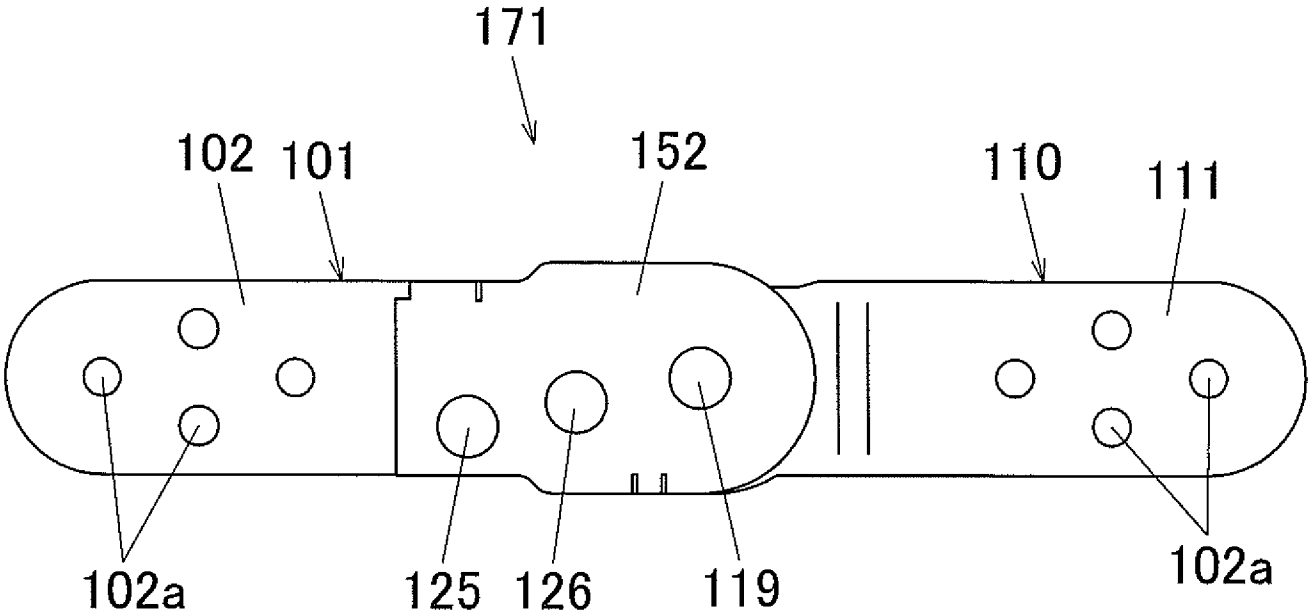
FIG. 16B is a side view showing the angle adjuster.
Figure 16C:
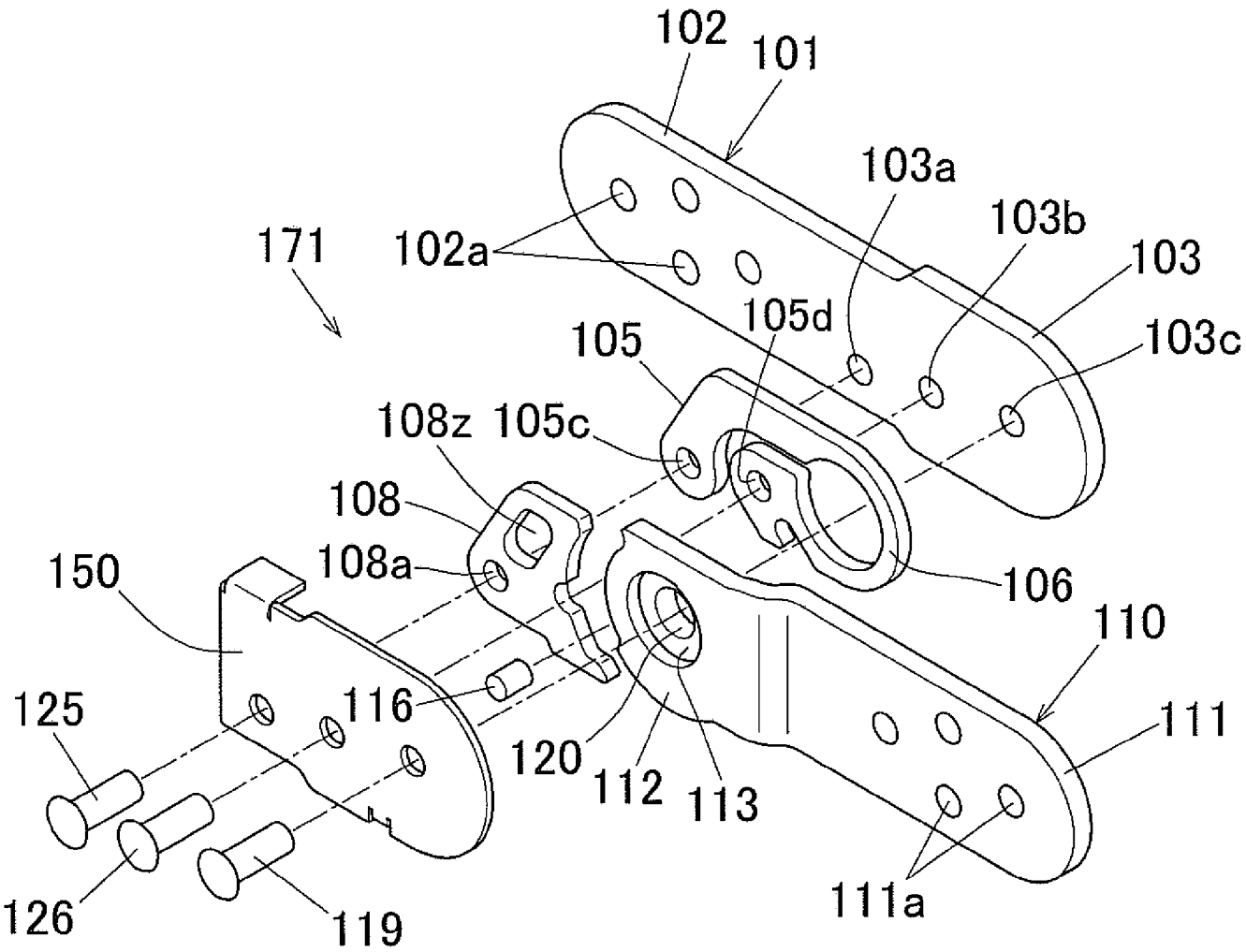
FIG. 16C is an exploded perspective view showing the angle adjuster.

FIGS. 16A to 16C are views for explaining an angle adjuster according to a third embodiment of the present invention. In these drawings, the similar symbols in which 100 has been added to the number are allotted to the constituent elements corresponding to the constituent elements of the angle adjuster 71 of the first embodiment.

The angle adjuster 171 is mainly used for furniture (e.g., sofa) having a plurality of wooden frames. In the angle adjuster 171, the attaching portion 102 of the first arm 101 is plate-shaped and attached to one of two wooden frames to be connected to each other by a fastener such as a wood screw, a bolt, or the like. The attaching portion 111 of the second arm 110 is plate-shaped and is to be attached to the other frame using a fastener such as a wood screw, a bolt, or the like. Therefore, a plurality of insertion holes 102*a* and 111*a* in which fasters are inserted are punched and formed in each attaching portion 102 and 111.

Also, in this angle adjuster 171, as shown in FIG. 16C, the number of the winding-and-tightening member 105 is 1, and the number of the outer plate portion 103 of the first arm 101 is also 1. Also, a through-hole 108*z* for reducing the weight of the spacer member 108 is punched and formed. In addition, the rotation shaft portion 113 of the second arm 110 is arranged inside the winding-and-tightening portion 106 of the winding-and-tightening member 105, creating a state in which the winding-and-tightening portion 106 of the winding-and-tightening member 105 is wound on the outer peripheral surface of the rotation shaft portion 113.

Furthermore, the angle adjuster 171 is equipped with a side cover plate 150 covering the rotation plate portion 112 of the second arm 110 from the side thereof. The side cover plate 150 and the winding-and-tightening member 105 are arranged in an opposed manner and sandwiching the rotation plate portion 112 and the spacer member 108 between both members 150 and 105. Furthermore, the side cover plate 150, the spacer member 108, the winding-and-tightening member 105, and the outer plate portion 103 of the first arm 101 are connected via the first rivet 125 and the second rivet 126. Furthermore, the side cover plate 150 and the outer plate portion 103 of the first arm 101 are connected to each other via the control member 119 constituted by a rivet.

The method of using the angle adjuster 171 is the same as the method of using the angle adjuster 71 of the first embodiment.

Figure 17A:
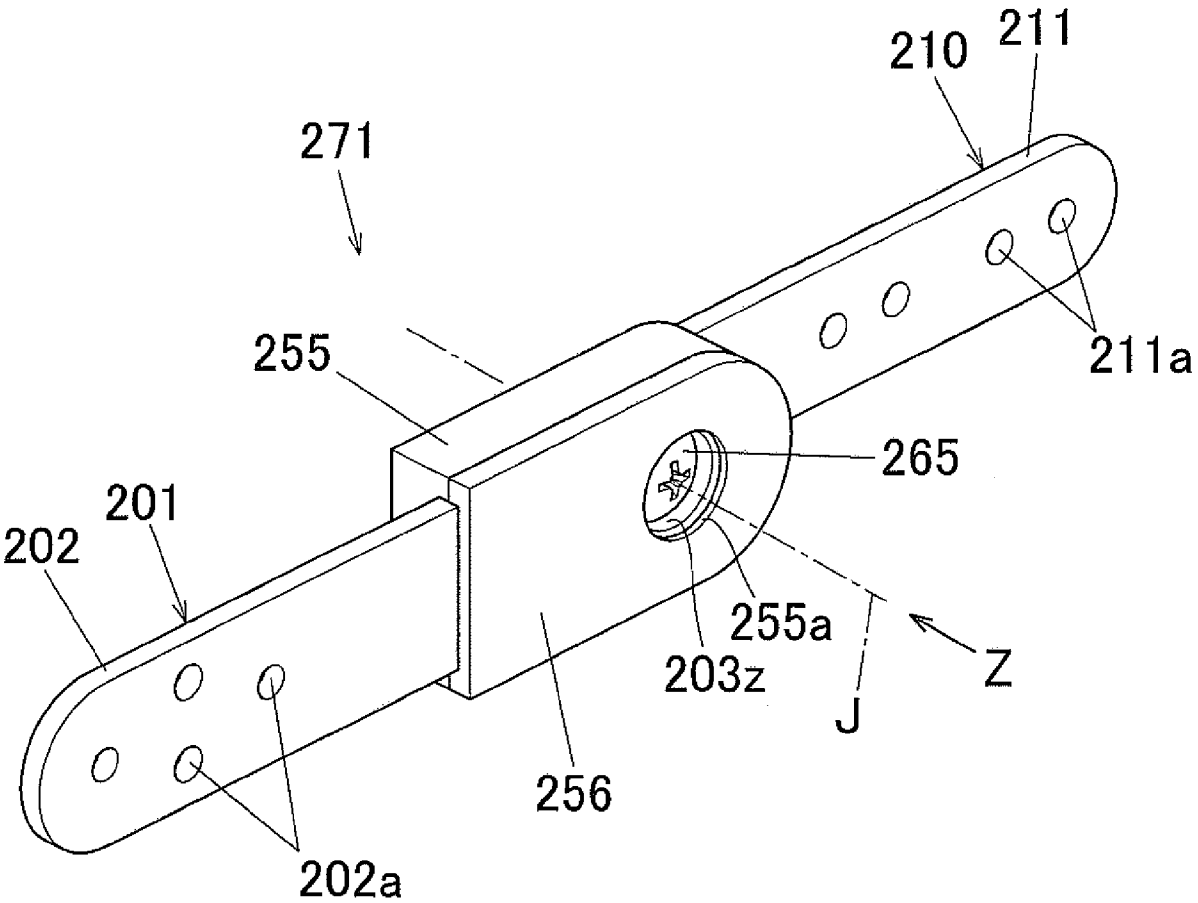
FIG. 17A is a perspective view showing an angle adjuster according to a fourth embodiment of the present invention.
Figure 17B:
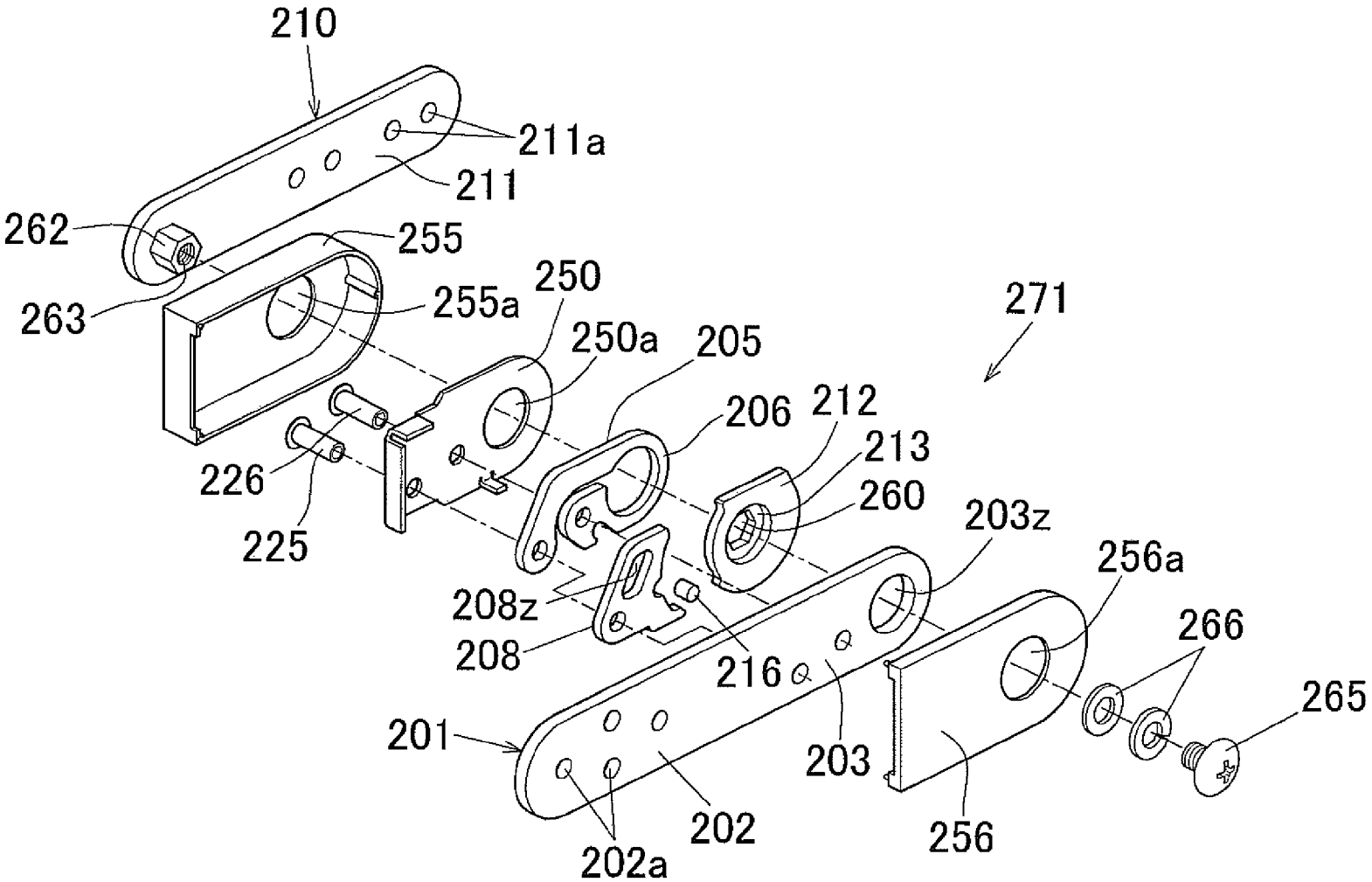
FIG. 17B is an exploded perspective view showing the angle adjuster.
Figure 17C:
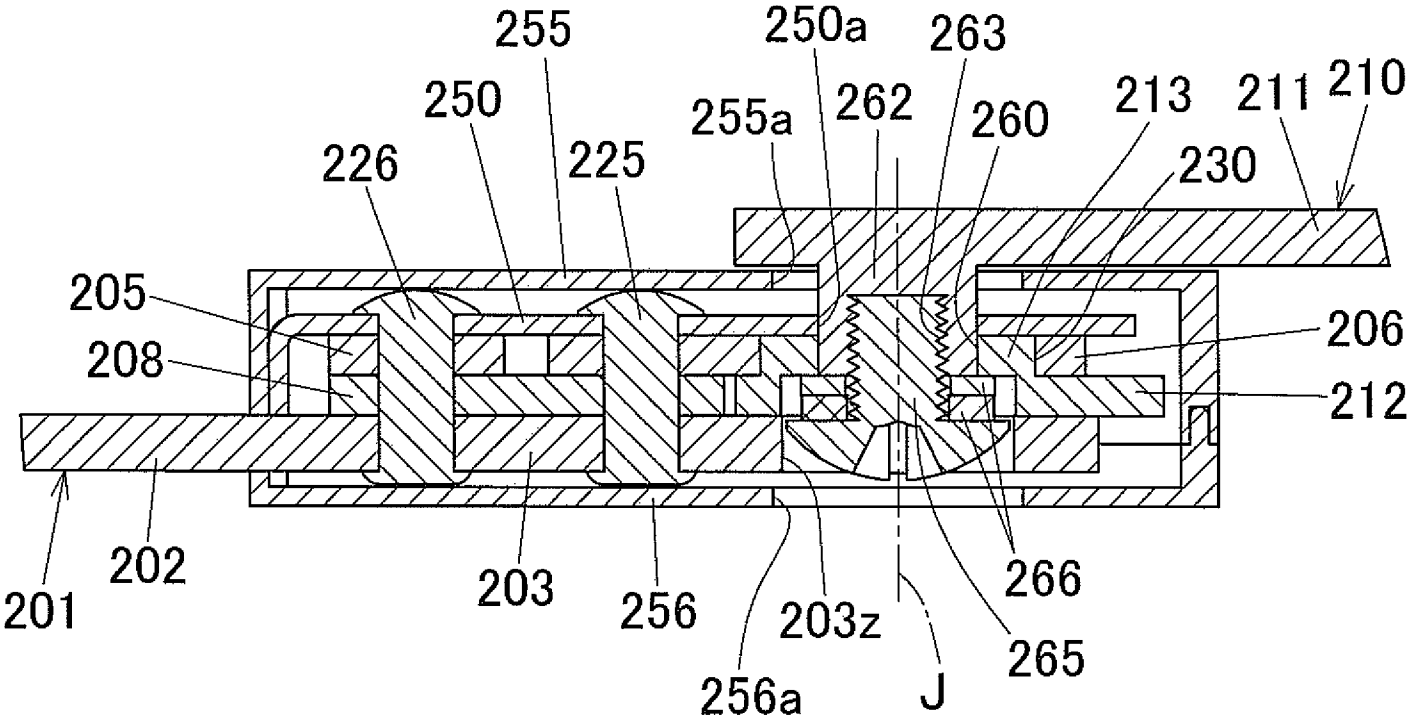
FIG. 17C is an enlarged cross-sectional view showing the angle adjuster.

FIGS. 17A to 17C are views for explaining an angle adjuster according to a fourth embodiment of the present invention. In these drawings, the similar symbols in which 200 has been added to the number are allotted to the constituent elements corresponding to the constituent elements of the angle adjuster 71 of the first embodiment.

The angle adjuster 271 is mainly used for furniture (e.g., sofa) having a plurality of wooden frames in the same manner as in the case of the angle adjuster 171 of the third embodiment. The attaching portion 202 of the first arm 201 is plate-shaped and to be attached to one of two wooden frames to be connected to each other by a fastener such as a wood screw, a bolt, or the like. The attaching portion 211 of the second arm 210 is plate-shaped and to be attached to the other frame using a fastener such as a wood screw, a bolt, or the like. Therefore, a plurality of insertion holes 202*a* and 211*a* in which a faster is inserted are punched and formed in each attaching portion 202 and 211.

Also, in this angle adjuster 271, as shown in FIG. 17B, the number of the winding-and-tightening member 205 is 1, and the number of the outer plate portion 203 of the first arm 201 is also 1. Also, a through-hole 208*z* for reducing the weight of the spacer member 208 is punched and formed.

A rotation plate 212 having a rotation shaft portion 213 is formed separately from the second arm 210. As shown in FIG. 17C, the rotation shaft portion 213 is arranged inside the winding-and-tightening portion 206 of the winding-and-tightening member 205, creating a state in which the winding-and-tightening portion 206 of the winding-and-tightening member 205 is wound on the outer peripheral surface of the rotation shaft portion 213. In FIG. 17C, the reference number 230 denotes a contact portion between the outer peripheral surface of the rotation shaft portion 213 and the inner peripheral surface of the winding-and-tightening portion 206.

As shown in FIG. 17B, at the central portion of the tip end portion of the rotation shaft portion 213, an engaging hole 260 having a non-circular shaped cross-section is provided in the axial direction of the rotation shaft portion 213 in a penetrated manner. In this embodiment, the cross-sectional shape of the engaging hole 260 is a regular polygon (specifically, regular hexagon). At the base end portion of the attaching portion 211 of the second arm 210, a fitting shaft portion 262 having a non-circular cross-sectional shape corresponding to the engaging hole 260 is integrally formed so as to be rotated together with the second arm. In this embodiment, the cross-sectional shape of the fitting shaft portion 262 is a regular polygonal shape (specifically, regular hexagonal shape).

Furthermore, as shown in FIG. 17B, the angle adjuster 271 is equipped with an outer case 255, a cover plate 256 for the outer case 255 and an inner side cover plate 250 covering the winding-and-tightening member 205 from the side thereof. Furthermore, as shown in FIGS. 17B and 17C, an inner side cover plate 250, a winding-and-tightening member 205, a spacer member 208, and an outer plate portion 203 of the first arm 201 are connected via the first rivet 225 and the second rivet 226. Furthermore, such members are accommodated inside the outer case 255 and the cover plate 256 is attached to the opening portion of the outer case 255.

The outer case 255 is provided with a through-hole 255*a* having a circular cross-sectional shape and the inner side cover plate 250 is provided with a through-hole 250*a* having a circular cross-sectional shape. Also, the fitting shaft portion 262 of the second arm 210 is inserted into the through-holes 255*a* and 250*a* from the outside of the outer case 255, and furthermore the fitting shaft portion 262 is engaged with the engaging hole 260 of the rotation shaft portion 213 in an engageable and detachable manner.

The cover plate 256 is provided with a through-hole 256*a* having a circular cross-sectional shape and the outer plate portion 203 of the first arm 201 is also provided with a through-hole 203*z* having a circular cross-sectional shape. In addition, inside these through-holes 256*a* and 203*z*, a retaining screw 265 is screwed into the screw hole 263 provided at the tip end portion of the fitting shaft portion 262 via a plurality of washers 266 (specifically, spring washer and flat washer) in an engageable and detachable manner. Thus, it is configured such that the fitting shaft portion 262 will not detach from the engaging hole 260.

In this angle adjuster 271, when attaching a frame to the attaching portion of each arm, the screw 265 is removed from the screw hole 263 and the fitting shaft portion 262 is detached from the engaging hole 260 to separate the first arm 201 and the second arm 210. Next, a frame is attached to the attaching portion of each arm using a fastener such as a wood screw, a bolt, or the like. At this time, since both arms 201 and 210 are separated, the attachment operation can be easily performed. After the attachment operation is finished, the fitting shaft portion 262 is again engaged with the engaging hole 260 to screw the screw 265 into the screw hole 263. In this way, the first arm 201 and the second arm 210 are connected to each other.

According to the angle adjuster 271, the fitting shaft portion 262 of the second arm 210 is engaged with the engaging hole 260 of the rotation shaft portion 213 in an engageable and detachable manner. Therefore, by detaching the fitting shaft portion 262 from the engaging hole 260 and then rotating the fitting shaft portion 262 with respect to the engaging hole 260 to fit it into the engaging hole 260 again, the starting development angle and the ending development angle of the second arm 210 can be changed while maintaining the adjustable range of the development angle of the second arm 210.

Although some embodiments of the present invention have been described herein, the present invention is not limited to the aforementioned embodiments and can be modified in various ways within a range in which the gist of the present invention is not changed.

For example, in the first embodiment, the angle adjuster is used as an angle adjuster for tilting the back frame of the seat chair, but in the present invention, the angle adjuster is not limited to that use for the seat chair and can be used for, for example, an angle adjuster for an arm rest of a chair having an armrest, an angle adjuster for a footrest for a chair having a footrest, and an inclination angle adjuster for a tabletop of a desk. Furthermore, it can be used for a foldable bed, or a panel supporting device for supporting a panel such as a liquid display panel, an organic EL display panel or the like, so that the angle is adjustable.

Further, in the present invention, it is especially preferable that the winding-and-tightening member has spring elasticity as explained in the abovementioned embodiments, but it does not exclude a member not having spring elasticity, and e.g., it does not exclude a case in which the winding-and-tightening member is constituted by a chain.

Further, the present invention does not exclude a structure in which the development angle of the second arm with respect to the first arm is adjusted stepwisely according to the technical idea of the angle adjuster of the present invention.

This application claims priority to Japanese Patent Application No. 2012-104700 filed on May 1, 2012, and the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

INDUSTRIAL APPLICABILITY

The present invention can be utilized for an angle adjuster for use in furniture (for example: reclining chair, foldable bed, foldable sofa) and a reclining chair equipped with the angle adjuster.

DESCRIPTION OF THE REFERENCE NUMERALS

1: first arm
3: outer plate portion
5: winding-and-tightening member
5*a*: one end portion of the winding-and-tightening member
5*b*: the other end portion of the winding-and-tightening member
6: winding-and-tightening portion
6*c*: inner peripheral surface of the winding-and-tightening portion
8: spacer member
8*c*: pressing portion (release means)
8*d*: stopper portion
9: gap
10: second arm
12: rotation plate portion (release means)
12*a*: first pushing portion (release means)
12*b*: second pushing portion (release means)
13: rotation shaft portion
13*a*: outer peripheral surface of the rotation shaft portion
15: release means
16: pressing member (release means)
18: control means
19: control member (control means)
20: control hole (control means)
25: first rivet
26: second rivet
30: contact portion
40: blank metal plate
42: upper cover member
43: lower cover member
71,72: angle adjuster
S: forward rotation direction
G: reverse rotation direction
SK: load in the forward rotation direction
GK: load in the reverse rotation direction
SM: frictional force in the forward rotation direction
GM: frictional force in the reverse rotation direction
P0: central position of the winding-and-tightening portion of the winding-and-tightening member
P1: first pivot position (first fixed position)
P2: second pivot position (second fixed position)
L1: first distance
L2: second distance
Q: axis position of the rotation shaft portion
U: loosening direction
V: winding-and-tightening direction
X: pressing position
Y: non-pressing position

The invention claimed is:

1. An angle adjuster comprising:

a first arm equipped with a winding-and-tightening member; and a second arm equipped with a rotation shaft portion, wherein, the rotation shaft portion is provided at the second arm so as to rotate together with the second arm, as seen in an axial direction of the rotation shaft portion, one end portion of the winding-and-tightening member and the other end portion of the winding-and-tightening member are arranged apart from each other and provided at the first arm, the first arm and the second arm are connected so that the second arm is rotatable relative to the first arm about the rotation shaft portion in a state in which a winding-and-tightening portion of the winding-and-tightening member is wound around an outer peripheral surface of the rotation shaft portion, a frictional force in a forward rotation direction of the second arm generated at a contact portion between the outer peripheral surface of the rotation shaft portion and an inner peripheral surface of the winding-and-tightening portion of the winding-and-tightening member by a rotational movement of the second arm in the forward rotation direction acts on the winding-and-tightening member in a loosening direction that loosens tightening of the outer peripheral surface of the rotation shaft portion to decrease a winding-and-tightening force of the winding-and-tightening member against the outer peripheral surface of the rotation shaft portion to thereby allow a rotation of the second arm in the forward rotation direction, and a frictional force in a reverse rotation direction of the second arm generated at the contact portion by a rotational movement of the second arm in the reverse rotation direction acts on the winding-and-tightening member in a winding-and-tightening direction that tightens the outer peripheral surface of the rotation shaft portion to increase the winding-and-tightening force of the winding-and-tightening member against the outer peripheral surface of the rotation shaft portion to thereby prevent a rotation of the second arm in the reverse rotation direction.

2. The angle adjuster as recited in claim 1, wherein the winding-and-tightening member has spring elasticity in the winding-and-tightening direction and the loosening direction, and in a state in which the winding-and-tightening portion of the winding-and-tightening member is wound around the outer peripheral surface of the rotation shaft portion, the outer peripheral surface of the rotation shaft portion is wound and tightened consistently by spring elasticity of the winding-and-tightening member.

3. The angle adjuster as recited in claim 1 or 2, wherein the one end portion and the other end portion of the winding-and-tightening member are positionally fixed to the first arm, and as seen in the axial direction of the rotation shaft portion, when a fixed position of the one end portion of the winding-and-tightening member to the first arm is denoted by a first fixed portion;

a fixed position of the other end portion of the winding-and-tightening member to the first arm is denoted by a second fixed position;

a linear distance between the first fixed position and a central position of the winding-and-tightening portion of the winding-and-tightening member is denoted by a first distance; and a linear distance between the second fixed position and the central position of the winding-and-tightening portion of the winding-and-tightening member is denoted by a second distance, the second distance is set to be shorter than the first distance, the forward rotation direction of the second arm is set in a rotation direction of unwinding a section of the winding-and-tightening portion of the winding-and-tightening member on a side of the first fixed position from the outer peripheral surface of the rotation shaft portion, and the reverse rotation direction of the second arm is set in a rotation direction of winding a section of the winding-and-tightening portion of the winding-and-tightening member on the side of the first fixed position on the outer peripheral surface of the rotation shaft portion.

4. The angle adjuster as recited in claim 3, wherein, as seen in the axial direction of the rotation shaft portion, when a line connecting the first fixed position and the central position of the winding-and-tightening portion of the winding-and tightening member is denoted by a reference line, the second fixed position is arranged within a range of ±45° with respect to the reference line centering the central position of the winding-and-tightening portion.

5. The angle adjuster as recited in claim 3, wherein, as seen in the axial direction of the rotation shaft portion, when a line connecting the first fixed position and the central position of the winding-and-tightening portion of the winding-and tightening member is denoted by a reference line, the second fixed position is arranged within a range of 0° to 45° to a downstream side in the reverse rotation direction of the rotation shaft portion of the second arm with respect to the reference line centering the central position of the winding-and-tightening portion.

6. The angle adjuster as recited in claim 1, wherein the winding-and-tightening member is formed separately from the first arm.

7. The angle adjuster as recited in claim 6, wherein the one end portion and the other end portion of the winding-and-tightening member are pivotally fixed to the first arm.

8. The angle adjuster as recited in claim 1, wherein the winding-and-tightening member is formed by punching out a blank metal plate along an outer shape of the winding-and-tightening member in a thickness direction of the blank metal plate and has spring elasticity in the winding-and-tightening direction and the loosening direction.

9. The angle adjuster as recited in claim 1, wherein the inner peripheral surface of the winding-and-tightening portion of the winding-and-tightening member is in contact with the outer peripheral surface of the rotation shaft portion in a region of 180° (degrees) or more centering an axial center position of the rotation shaft portion.

10. The angle adjuster as recited in claim 1, wherein the inner peripheral surface of the winding-and-tightening portion of the winding-and-tightening member is formed into a shape corresponding to a shape of the outer peripheral surface of the rotation shaft portion.

11. The angle adjuster as recited in claim 1, further comprising a control means of controlling an amount of deformation in the winding-and-tightening direction of the winding-and-tightening member caused by an action of a friction force in the reverse rotation direction applied to the winding-and-tightening member in the winding-and-tightening direction.

12. The angle adjuster as recited in claim 11, wherein the control means includes a control member and a control hole formed in the rotation shaft portion so as to extend in the axial direction of the rotation shaft portion, a diameter of the control hole is set to be larger than a diameter of the control member, the control member is arranged inside the control hole, and the control means is configured such that, when the amount of deformation in the winding-and-tightening direction of the winding-and-tightening member reaches a predetermined amount, an inner peripheral surface of the control hole comes into contact with the control member to thereby control the amount of deformation of the winding-and-tightening member in the winding-and-tightening direction.

13. The angle adjuster as recited in claim 12, wherein a pair of outer plate portions arranged apart from each other in an opposed manner are provided at the first arm, and the winding-and-tightening member and the rotation shaft portion are arranged between both the outer plate portions, wherein the control hole is formed in the rotation shaft portion in a penetrated manner in the axial direction of the rotation shaft portion, the control member is constituted by a rivet, an insertion hole for the control member is formed in each of the outer plate portions, and both the outer plate portions are connected to each other via the control member inserted through both the insertion holes and the control hole.

14. The angle adjuster as recited in claim 12, wherein the control means is configured such that, when an amount of deformation in the loosening direction of the winding-and-tightening member generated by an action of a frictional force in the forward rotation direction applied to the winding-and-tightening member in the loosening direction reaches a predetermined amount, the inner peripheral surface of the control hole comes into contact with the control member to thereby control the amount of deformation of the winding-and-tightening member in the loosening direction.

15. The angle adjuster as recited in claim 1, wherein the first arm is provided with a stopper portion for stopping a rotation of the second arm in the forward rotation direction by being brought into contact with the second arm maximally rotated in the forward rotation direction.

16. The angle adjuster as recited in claim 1, further comprising a release means configured to release prevention of the rotation of the second arm in the reverse rotation direction.

17. The angle adjuster as recited in claim 16, wherein the release means includes a pressing member which presses and deforms the winding-and-tightening member in the loosening direction to reduce the winding-and-tightening force of the winding-and-tightening member to thereby release the prevention of the rotation of the second arm in the reverse rotation direction, and a rotation plate portion integrally formed on the second arm in a rotatable manner, the pressing member is arranged movably between a pressing position where the winding-and-tightening member is pressed and deformed in the loosening direction and a non-pressing position where the winding-and-tightening member is not pressed and deformed, and the rotation plate portion is provided with a first pushing portion for pushing the pressing member arranged at the non-pressing position to the pressing position when the second arm maximally rotates to the forward rotation direction.

18. The angle adjuster as recited in claim 17, wherein the rotation plate portion is further provided with a second pushing portion for pushing the pressing member arranged at the pressing position to the non-pressing position when the second arm maximally rotates in the reverse rotation direction.

19. The angle adjuster as recited in claim 17, wherein the pressing member is arranged on an outside of the outer peripheral surface of a section of the other end portion side of the winding-and-tightening portion of the winding-and-tightening member, the first am is provided with a pressing portion for pressing the pressing member arranged at the pressing position against the outer peripheral surface of the section of the other end portion side, the pressing portion is arranged so that a space between the pressing portion and the outer peripheral surface of the section of the other end portion side is smaller than a thickness dimension of the pressing member, and the pressing member is forcefully pressed in between the pressing portion and the outer peripheral surface of the section of the other end portion side so as to be arranged at the pressing position from the non-pressing position, so that the pressing member is pressed against the outer peripheral surface of the section of the other end portion side by the pressing portion to thereby press and deform the winding-and-tightening member in the loosening direction.

20. The angle adjuster as recited in claim 17, wherein the first arm is equipped with a pair of the winding-and-tightening members, both the winding-and-tightening members are arranged in an opposed manner sandwiching a spacer member for forming a gap between both the winding-and-tightening members, the spacer member is attached to the first arm in a fixed state, the rotation shaft portion is integrally formed at an approximately central portion of the rotation plate portion so as to rotate together with the rotation plate and protrude to both sides in a thickness direction of the rotation plate portion, the rotation plate portion is arranged at the gap between both the winding-and-tightening members, and each of the rotation shaft portions is arranged inside both the winding-and-tightening portions of both the winding-and-tightening members in a rotatable manner, the pressing member is arranged on outside of both the outer peripheral surfaces of sections of both the other end portion sides of both the winding-and-tightening portions of both the winding-and-tightening members so as to bridge both the outer peripheral surfaces of sections of both the other end portion sides, the spacer member is provided with a pressing portion for pressing the pressing member arranged at the pressing position against both the outer peripheral surfaces of the sections of both the other end portion sides, the pressing portion is arranged so that a space between the pressing portion and both the outer peripheral surfaces of sections of both the other end portion sides is smaller than a thickness dimension of the pressing member, and the pressing member is forcefully pressed in between the pressing portion and both the outer peripheral surfaces of sections of both the other end portion sides so as to be arranged at the pressing position from the non-pressing position, so that the pressing member is pressed against both the outer peripheral surfaces of the sections of both the other end portion sides by the pressing portion to thereby press and deform both the winding-and-tightening members in the loosening direction.

21. The angle adjuster as recited in claim 1, wherein a cover member for covering the winding-and-tightening member from at least one of a top side or a bottom side is provided in a detachable manner.

22. The angle adjuster as recited in claim 1, wherein the rotation shaft portion is formed separately from the second arm, the rotation shaft portion is provided with an engaging hole of a non-circular cross-sectional shape, the second arm is integrally provided with a fitting shaft portion of a non-circular cross-sectional shape corresponding to the engaging hole in a rotatable manner, and the fitting shaft portion is fitted in the engaging hole in a detachable manner to thereby integrally connect the rotation shaft portion to the second arm.

23. A reclining chair in which a seat frame is attached to the first arm of the angle adjuster as recited in claim 1 and a back frame is attached to the second arm of the angle adjuster.

* * * * *